US011597203B2

(12) United States Patent
Tomizawa et al.

(10) Patent No.: US 11,597,203 B2
(45) Date of Patent: Mar. 7, 2023

(54) LIQUID EJECTION HEAD INCLUDING A PLURALITY OF RECORDING ELEMENT SUBSTRATES FORMED ADJACENT TO EACH OTHER TO FORM AN ARRAY SUCH THAT A GAP IN TEMPERATURE DISTRIBUTION IS PREVENTED

(71) Applicant: CANON KABUSHIKI KAISHA, Tokyo (JP)

(72) Inventors: Keiji Tomizawa, Kanagawa (JP); Shuzo Iwanaga, Kanagawa (JP); Akiko Hammura, Tokyo (JP); Yoshihiro Hamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/354,489

(22) Filed: Jun. 22, 2021

(65) Prior Publication Data

US 2021/0402765 A1 Dec. 30, 2021

(30) Foreign Application Priority Data

Jun. 26, 2020 (JP) ..... JP2020-110698

(51) Int. Cl.
*B41J 2/14* (2006.01)
*B41J 2/16* (2006.01)

(52) U.S. Cl.
CPC . *B41J 2/14* (2013.01); *B41J 2/16* (2013.01); *B41J 2002/14346* (2013.01)

(58) Field of Classification Search
CPC ..... B41J 2/14; B41J 2/16; B41J 2002/14346; B41J 2/1404; B41J 2/14024; B41J 2202/12; B41J 2202/20; B41J 2202/21
See application file for complete search history.

(56) References Cited

U.S. PATENT DOCUMENTS

2017/0197420 A1* 7/2017 Okushima ..... B41J 2/1404
2017/0197439 A1* 7/2017 Okushima ..... B41J 2/14024

FOREIGN PATENT DOCUMENTS

JP 2017124619 A 7/2017

* cited by examiner

*Primary Examiner* — Bradley W Thies
(74) *Attorney, Agent, or Firm* — Canon U.S.A., Inc. I.P. Division

(57) ABSTRACT

In a liquid ejection head in which ejection modules are arrayed on a flow path forming member, each ejection module includes a recording element substrate provided on a support member. The recording element substrate includes a liquid supply channel, a liquid collection channel, and ejection ports. The support member includes supply-side liquid communication ports communicating with the liquid supply channel and collection-side liquid communication ports communicating with the liquid collection channel. The supply-side liquid communication ports and the collection-side liquid communication ports are alternately provided along the direction in which the ejection modules are arrayed. The closest pair of liquid communication ports in the adjacent ends of two adjacent ejection modules are both supply-side or collection-side liquid communication ports.

8 Claims, 15 Drawing Sheets

LIQUID EJECTION HEAD INCLUDING A PLURALITY OF RECORDING ELEMENT SUBSTRATES FORMED ADJACENT TO EACH OTHER TO FORM AN ARRAY SUCH THAT A GAP IN TEMPERATURE DISTRIBUTION IS PREVENTED

BACKGROUND

Field of the Disclosure

The present disclosure relates to a liquid ejection head and a liquid ejection apparatus having a liquid ejection head.

Description of the Related Art

For liquid ejection heads such as inkjet print heads that eject liquids such as recording liquids from ejection ports, a configuration to circulate the liquids through pressure chambers provided with the ejection ports has been known in order to prevent a rise in the viscosity of the liquids due to evaporation from the ejection ports. With this configuration, the flow rate and the pressure may vary among the pressure chambers in the case where a plurality of ejection ports are densely arranged. In a liquid ejection head disclosed in Japanese Patent Application Laid-Open No. 2017-124619 intended to reduce these variations, recording element substrates are provided with flow paths for respective pressure chambers arranged along each ejection port array, and a plurality of supply ports and a plurality of collection ports through which to circulate a liquid through the respective flow paths are arranged in the form of arrays. There are also provided a common supply flow path through which to supply the liquid from a supply-side communication port to the plurality of supply ports and a common collection flow path through which to collect the liquid from the plurality of collection ports into a collection-side communication port. In each recording element substrate, at least the supply-side communication ports or the collection-side communication ports are provided at a plurality of positions.

In the liquid ejection head disclosed in Japanese Patent Application Laid-Open No. 2017-124619, when two or more recording element substrates each having a plurality of and the same number of supply-side communication ports and collection-side communication ports are arranged adjacent to each other, a difference appears in temperature distribution between the adjacent recording element substrates in some cases (a state where the temperature distribution between adjacent recording element substrates is not continuous but has a difference will be hereinafter expressed as "gap" for convenience). If the gap in temperature distribution appears, the liquid ejection head, when used, for example, as an inkjet print head for forming an image on a recording medium, may cause unevenness such as density unevenness in a formed image.

SUMMARY

An aspect of the present disclosure is to provide a liquid ejection head which is formed by arranging a plurality of recording element substrates adjacently to each other in the form of an array and in which a gap in temperature distribution is prevented from appearing between the adjacent recording element substrates.

One embodiment of the liquid ejection head of the present disclosure is a liquid ejection head in which a plurality of ejection modules are arrayed on a flow path forming member. Each of the ejection modules includes a support member and a recording element substrate provided on the support member. The recording element substrate includes a liquid supply channel and a liquid collection channel extending in a direction in which the ejection modules are arrayed, and a plurality of ejection ports arrayed in the direction. The support member includes a plurality of supply-side liquid communication ports through which to supply a liquid to the liquid supply channel and a plurality of collection-side liquid communication ports through which to collect the liquid from the liquid collection channel. The plurality of supply-side liquid communication ports and the plurality of collection-side liquid communication ports are alternately arranged along the direction. The plurality of ejection modules are arrayed on the flow path forming member such that a closest pair of liquid communication ports in adjacent ends of two adjacent ejection modules are both supply-side or collection-side liquid communication ports.

Further features of the present disclosure will become apparent from the following description of exemplary embodiments with reference to the attached drawings.

DESCRIPTION OF THE EMBODIMENTS

Preferred embodiments of the present disclosure will be described below with reference to the drawings. The embodiments to be described below are appropriate specific examples of the present disclosure and therefore involve various technically preferable limitations. However, the present disclosure is not limited to the following embodiments or other specific configurations as long as the concept of the present disclosure is followed. A liquid ejection head based on the present disclosure is characterized in that a gap in temperature distribution is prevented from appearing between adjacent recording element substrates. The following description will be given by taking, as an example, a so-called thermal liquid ejection head which uses a heat generation element that generates energy for ejecting a liquid as each recording element, and generates an air bubble in the liquid in a pressure chamber by means of heat to eject the liquid from an ejection port. However, liquid ejection heads to which the present disclosure is applicable are not limited to ones employing the thermal method. The present disclosure is applicable also to liquid ejection heads employing a piezoelectric method that uses a piezoelectric element and liquid ejection heads employing various other liquid ejection methods. Liquid ejection heads employing methods other than the thermal method, too, eject liquids by applying energy to the liquids and therefore generate heat in their recording element substrates, which leads to a possibility that a gap in temperature distribution appears between adjacent recording element substrates.

The liquid ejection head and the liquid ejection apparatus based on the present disclosure are applicable to apparatuses such as printers, copying machines, facsimiles with a communication system, and word processors with a printer unit, and further to industrial recording apparatuses integrally combined with various processing apparatuses. The liquid ejection head and the liquid ejection apparatus based on the present disclosure can also be used in applications such as fabrication of a biochip and printing of an electronic circuit.

(Description of Liquid Ejection Apparatus)

Figure 1:
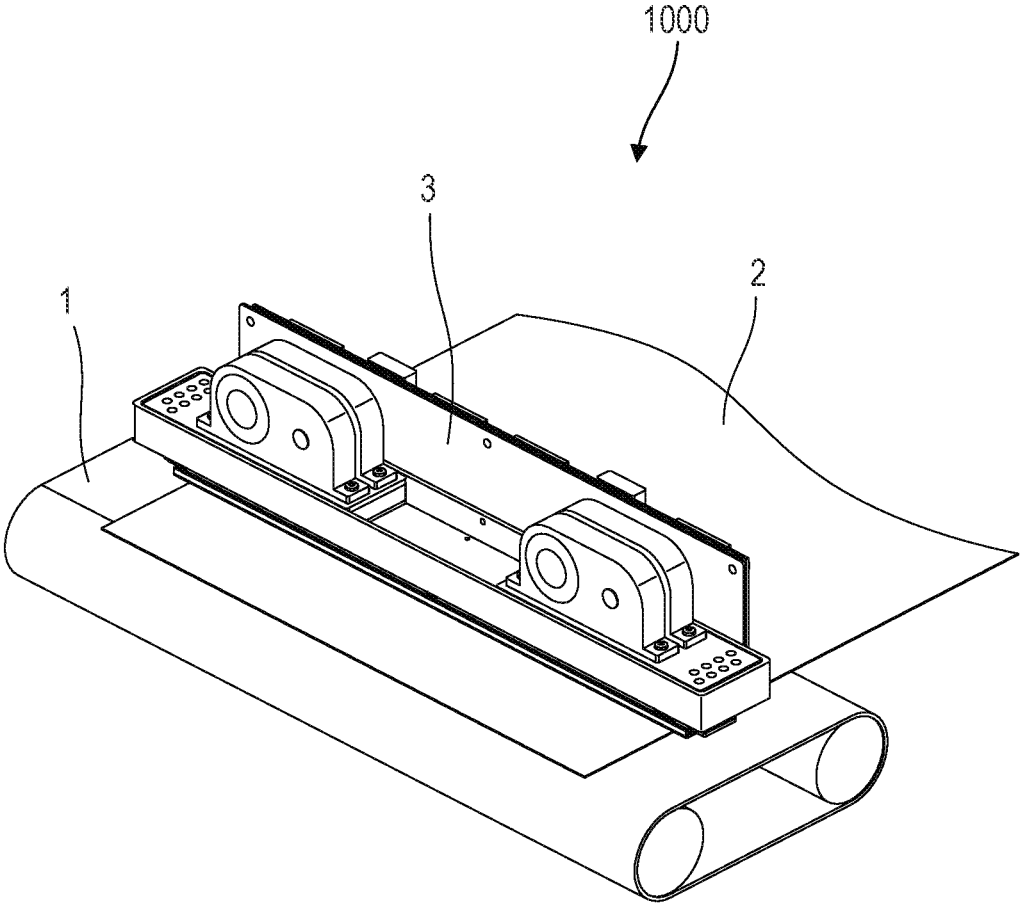
FIG. 1 is a perspective view illustrating a schematic configuration of a liquid ejection apparatus.

Firstly, prior to the description of the embodiments of the present disclosure, a liquid ejection apparatus to which the present disclosure is applicable will be described. In the following, an inkjet recording apparatus 1000 (hereinafter also referred to as the recording apparatus) that performs recording on a recording medium by ejecting recording liquids as liquids thereonto from ejection ports will be described as an example of the liquid ejection apparatus to which the present disclosure is applicable. FIG. 1 illustrates a schematic configuration of a part related to recording taken out of the recording apparatus 1000, which is a liquid ejection apparatus. The recording apparatus 1000 is a line-type recording apparatus that includes a conveyance unit 1 which conveys a recording medium 2 and a line-type liquid ejection head 3 arranged substantially perpendicular to the conveyance direction of the recording medium 2, and performs 1-pass continuous recording on a plurality of the recording media 2 while conveying them continuously or intermittently. Each recording medium 2 is, for example, a cut paper sheet but may be a continuous paper roll or the like instead of a cut paper sheet. The liquid ejection head 3 is capable of performing full-color recording with recording liquids or inks of cyan (C), magenta (M), yellow (Y), and black (K) colors (hereinafter these colors will also be collectively referred to as CMYK).

Figure 2:
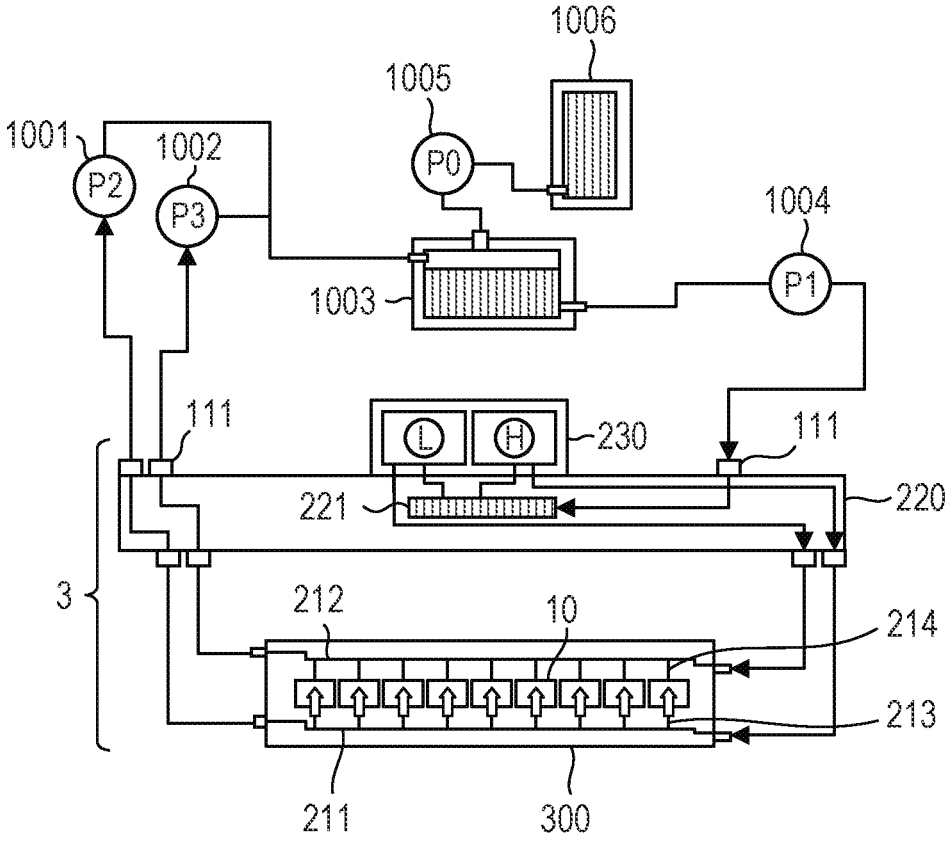
FIG. 2 is a diagram illustrating an example of a circulation configuration in the liquid ejection apparatus.

The recording apparatus 1000 illustrated in FIG. 1 is configured to circulate liquid such as recording liquid between a tank to be described later and the liquid ejection head 3. A liquid circulation mechanism and a part of the liquid ejection head 3 related to the liquid circulation will be described below using FIG. 2. As illustrated in FIG. 2, the liquid ejection head 3 mainly includes liquid connection portions 111, a liquid supply unit 220, a negative pressure control unit 230, a liquid ejection unit 300, and a housing 80 (see FIG. 4). The negative pressure control unit 230 controls the pressure (negative pressure) in circulation channels, and the liquid supply unit 220 fluidly communicates with the negative pressure control unit 230. The liquid connection portions 111 serve as supply and discharge ports through which to supply and discharge the recording liquid into and out of the liquid supply unit 220. A liquid supply system including supply channels for supplying the recording liquid to the liquid ejection head 3, as well as a main tank 1006 and a buffer tank 1003 (see FIG. 2), is fluidly connected to the liquid ejection head 3 through the liquid connection portions 111.

The liquid ejection unit 300 is provided with a plurality of recording element substrates 10, a common supply flow path 211, and a common collection flow path 212. Each recording element substrate 10 is provided with a plurality of recording elements. In the liquid ejection unit 300, the recording liquid is supplied to each recording element substrate 10 from the common supply flow path 211 as indicated by illustrated arrows, and the recording liquid is collected through the common collection flow path 212. Also, an electric controller that transfers electrical power and ejection control signals to the liquid ejection head 3 is electrically connected to the liquid ejection head 3. Details of the liquid channels and electrical signal channels in the liquid ejection head 3 will be described later.

(Description of Circulation Configuration)

Next, a recording liquid circulation configuration in the recording apparatus 1000 illustrated in FIG. 1 will be described. Here, a configuration of circulating the recording liquid by operating two high-pressure and low-pressure circulation pumps 1001 and 1002 provided downstream of the liquid ejection head 3 will be described using FIG. 2. However, the recording liquid circulation configuration in the recording apparatus 1000 is not limited to the one to be discussed here.

In the circulation configuration illustrated in FIG. 2, the liquid ejection head 3 is fluidly connected to the high-pressure side first circulation pump (P2) 1001, the low-pressure side first circulation pump (P3) 1002, the buffer tank 1003, and so on. Note that while FIG. 2 illustrates only the channel through which the recording liquid of one color among the recording liquids of the colors of CMYK flows for a simple explanation, the liquid ejection head 3 and the main body of the recording apparatus are actually provided with circulation channels for the four colors. The recording liquid in the main tank 1006 is supplied to the buffer tank 1003 by a replenishment pump (P0) 1005 and then supplied to the liquid supply unit 220 of the liquid ejection head 3 by a second circulation pump (P1) 1004 through the liquid connection portion 111. The recording liquid supplied to the liquid supply unit 220 is adjusted to two different negative pressures (high pressure and low pressure) at the negative pressure control unit 230, which is connected to the liquid supply unit 220, and branched and circulated through two flow paths on a high-pressure side (H) and a low-pressure side (L). By the operation of the first circulation pump (high-pressure side P2) 1001 and the first circulation pump (low-pressure side P3) 1002 on the downstream side, the recording liquid in the liquid ejection head 3 is circulated through the liquid ejection head 3 and is then discharged from the liquid ejection head 3 through the liquid connection portions 111 and returned to the buffer tank 1003.

The buffer tank 1003, which is a sub-tank, is connected to the main tank 1006 and functions as a storage part that stores the recording liquid. Also, the buffer tank 1003 has an atmosphere communication port (not illustrated) through which the inside and outside of the tank communicate with each other, and is capable of discharging air bubbles in the recording liquid to the outside. The above-mentioned replenishment pump (P0) 1005 is provided between the buffer tank 1003 and the main tank 1006. When the recording liquid is consumed at the liquid ejection head 3 as a result of ejecting (discharging) the recording liquid from the ejection ports in the liquid ejection head for recording, suction recovery, or the like, which involves ejection of the liquid, the replenishment pump 1005 transfers the consumed amount of the recording liquid from the main tank 1006 to the buffer tank 1003.

The two first circulation pumps 1001 and 1002, which function as a liquid transfer part, serve a role of drawing the liquids from the liquid connection portions 111 of the liquid ejection head 3 and causing them to flow to the buffer tank 1003. Positive displacement pumps having a quantitative liquid delivery ability are preferably used as the first circulation pumps 1001 and 1002. While specific examples include tube pumps, gear pumps, diaphragm pumps, syringe pumps, and so on, it is also possible to use, for example, general pumps configured to ensure a constant flow rate with a constant flow rate valve or a relief valve disposed at the exit of the pump. While the liquid ejection head 3 is driven, the recording liquids is caused to flow through the common supply flow path 211 and the common collection flow path 212 at a given constant flow rate by the high-pressure side first circulation pump 1001 and the low-pressure side first circulation pump 1002, respectively. Circulating the recording liquid in this manner enables the temperature of the liquid ejection head 3 to be maintained at an optimum temperature when recording is performed by ejecting the recording liquid. The predetermined flow rate of the recording liquid during the driving of the liquid ejection head 3 is preferably set at or above a flow rate at or above which the temperature difference among the recording element substrates 10 in the liquid ejection head 3 can be maintained at or below such a temperature as not to affect the recording quality on the recording medium 2. Incidentally, if an excessively high flow rate is set, the difference in negative pressure among the recording element substrates 10 will be excessively large due to the pressure drop in the flow path in the liquid ejection unit 300, which will cause density unevenness in the recorded image. It is therefore preferred to set the flow rate with the differences in temperature and negative pressure among the recording element substrates 10 taken into account.

The second circulation pump 1004 is provided to the channel through which to supply the recording liquids from the buffer tank 1003 to the liquid ejection head 3. The negative pressure control unit 230 is provided to the channels between the second circulation pump 1004 and the liquid ejection unit 300. The negative pressure control unit 230 operates so as to maintain the pressure downstream of the negative pressure control unit 230 (i.e., the liquid ejection unit 300 side) at a preset constant pressure even when the flow rate of the recording liquid in the circulation system varies due to a difference in ejection amount per unit area or the like. The negative pressure control unit 230 includes two negative pressure adjustment mechanisms whose control pressures are set at different values. Any mechanisms may be used as these two negative pressure adjustment mechanisms as long as each of them is capable of controlling the downstream pressure within a certain range of variation centered at a desired preset pressure. In one example, mechanisms similar to a so-called pressure reducing regulator can be employed. In the circulation configuration illustrated in FIG. 2, the second circulation pump 1004 pressurizes the upstream side of the negative pressure control units 230 through the liquid supply unit 220. This makes it possible to reduce the influence of the hydraulic head pressure of the buffer tank 1003 on the liquid ejection head 3 and thus enhance the degree of freedom in arrangement of the buffer tank 1003 in the recording apparatus 1000.

The second circulation pump 1004 only needs to be one that exerts a certain pump head pressure or higher within the range of flow rates for the recording liquid circulation to be used during the driving of the liquid ejection head 3, and a turbo-pump, a positive displacement pump, or the like can be used. Specifically, a diaphragm pump or the like can be used. Also, instead of the second circulation pump 1004, a hydraulic head tank can be provided which is arranged with a certain hydraulic head difference relative to the negative pressure control units 230, for example.

As described above, the negative pressure control unit 230 includes two negative pressure adjustment mechanisms whose control pressures are set at different values. Of the two negative pressure adjustment mechanisms, the negative pressure adjustment mechanism set at the higher pressure (illustrated as H in FIG. 2) is connected to the common supply flow path 211 in the liquid ejection unit 300 through the inside of the liquid supply unit 220. Similarly, the negative pressure adjustment mechanism set at the lower pressure (illustrated as L in FIG. 2) is connected to the common collection flow path 212 in the liquid ejection unit 300 through the inside of the liquid supply unit 220.

Besides the common supply flow path 211 and the common collection flow path 212, the liquid ejection unit 300 is provided with individual supply flow paths 213 and individual collection flow paths 214 each communicating with a recording element substrate 10. The individual supply flow paths 213 and the individual collection flow paths 214 provided for each recording element substrate will be collectively referred to as the individual flow paths. The individual flow paths are provided in communication with the common supply flow path 211 and the common collection flow path 212 so as to branch off from the former and merge into the latter. The high-pressure side negative pressure adjustment mechanism H is connected to the common supply flow path 211, and the low-pressure side negative pressure adjustment mechanism L is connected to the common collection flow path 212. Accordingly, a differential pressure is generated between the common supply flow path 211 and the common collection flow path 212. This causes part of the liquid such as the recording liquid to flow from the common supply flow path 211 to the common collection flow path 212 through flow paths inside the recording element substrates 10 (see the outlined arrows in FIG. 2).

Thus, in the liquid ejection unit 300, flow of the liquid is generated such that the liquid flows through the common supply flow path 211 and the common collection flow path 212 while at the same time part of the liquid flows through the recording element substrates 10. This enables heat generated in the recording element substrates 10 to be discharged to the outside of the recording element substrates 10 by the recording liquids flowing through the common supply flow path 211 and the common collection flow path 212. Also, with such a configuration, while the liquid ejection head 3 is performing recording, flow of the recording liquid can be generated also in the ejection ports and pressure chambers not used in the recording. In this way, it is possible to prevent an increase in the viscosity of the recording liquid due to evaporation of the solvent component in the recording liquid from the ejection ports or the like. It is also possible to discharge part of the recording liquid whose viscosity has increased and foreign matter in the recording liquid to the common collection flow path 212. Accordingly, high-speed and high-quality recording is possible by using the liquid ejection head 3 described above.

(Description of Configuration of Liquid Ejection Head)

Figure 3A:
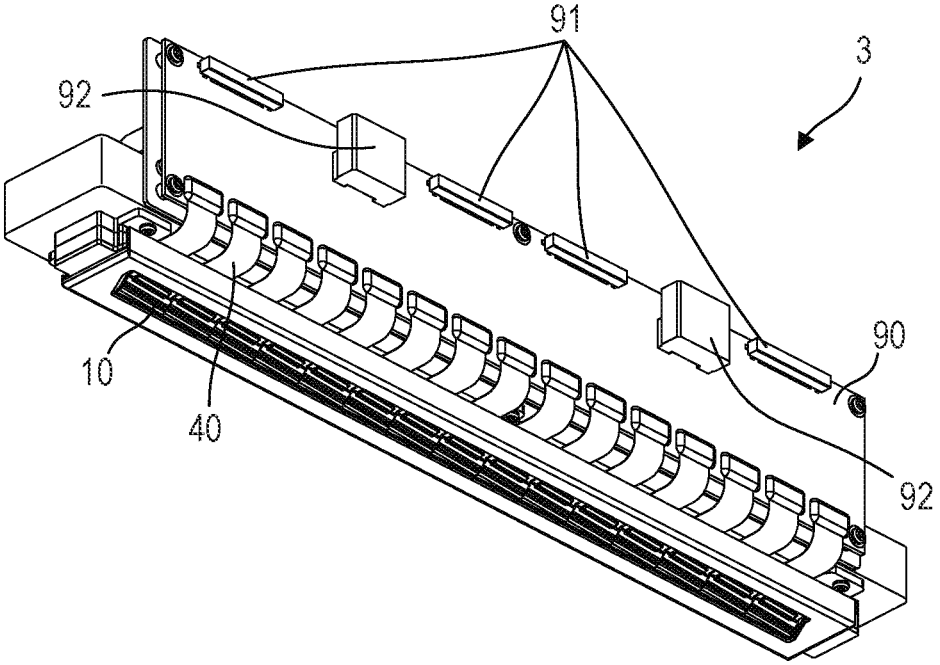
FIG. 3A is a perspective view of a liquid ejection head as seen from its side with a surface where ejection ports are formed.
Figure 3B:
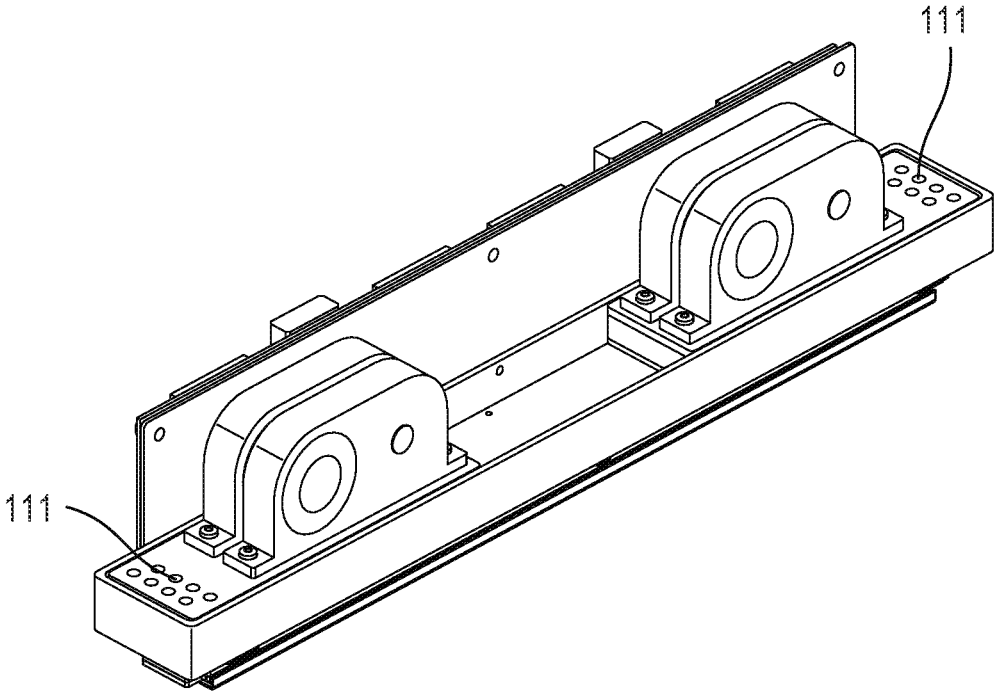
FIG. 3B is a perspective view of the liquid ejection head as seen from the direction opposite to that in FIG. 3A.

Next, a configuration of the liquid ejection head 3 will be described using FIGS. 3A and 3B. FIG. 3A is a perspective view of the liquid ejection head 3 as seen from its side with a surface where the ejection ports are formed, and FIG. 3B is a perspective view of the liquid ejection head 3 as seen from the direction opposite to that in FIG. 3A. The liquid ejection head 3 is a line-type liquid ejection head in which 15 recording element substrates 10 each capable of ejecting the recording liquids of the 4 colors of cyan (C), magenta (M), yellow (Y) and black (K) are arrayed in a straight line (in-line arrangement).

As illustrated in FIG. 3A, the liquid ejection head 3 includes 15 recording element substrates 10 and flexible wiring substrates 40 and an electric wiring substrate 90. The electric wiring substrate 90 is provided with signal input terminals 91 and power supply terminals 92. The signal input terminals 91 and the power supply terminals 92 are electrically connected to the recording element substrates 10 via the electric wiring substrate 90 and the flexible wiring substrates 40. The signal input terminals 91 and the power supply terminals 92 are electrically connected to the controller in the recording apparatus 1000, and respectively supply ejection driving signals and electrical power necessary for ejection to the recording element substrates 10. The electric circuit in the electric wiring substrate 90 gathers wirings so that the number of signal input terminals 91 and the number of power supply terminals 92 can be smaller than the number of recording element substrates 10. This can reduce the number of electrically connected components that need to be detached at the time of assembling the liquid ejection head 3 to the recording apparatus 1000 or replacing the liquid ejection head 3.

As illustrated in FIG. 3B, the liquid connection portions 111, which are provided at both end portions of the liquid ejection head 3, are connected to a liquid supply system in the recording apparatus 1000. In this way, the recording liquids of the colors of CMYK are supplied to the liquid ejection head 3 from the supply system in the recording apparatus 1000, and the recording liquids having passed through the liquid ejection head 3 are collected into the supply system in the recording apparatus 1000. The recording liquid of each color can thus be circulated through channels in the recording apparatus 1000 and channels in the liquid ejection head 3.

Figure 4:
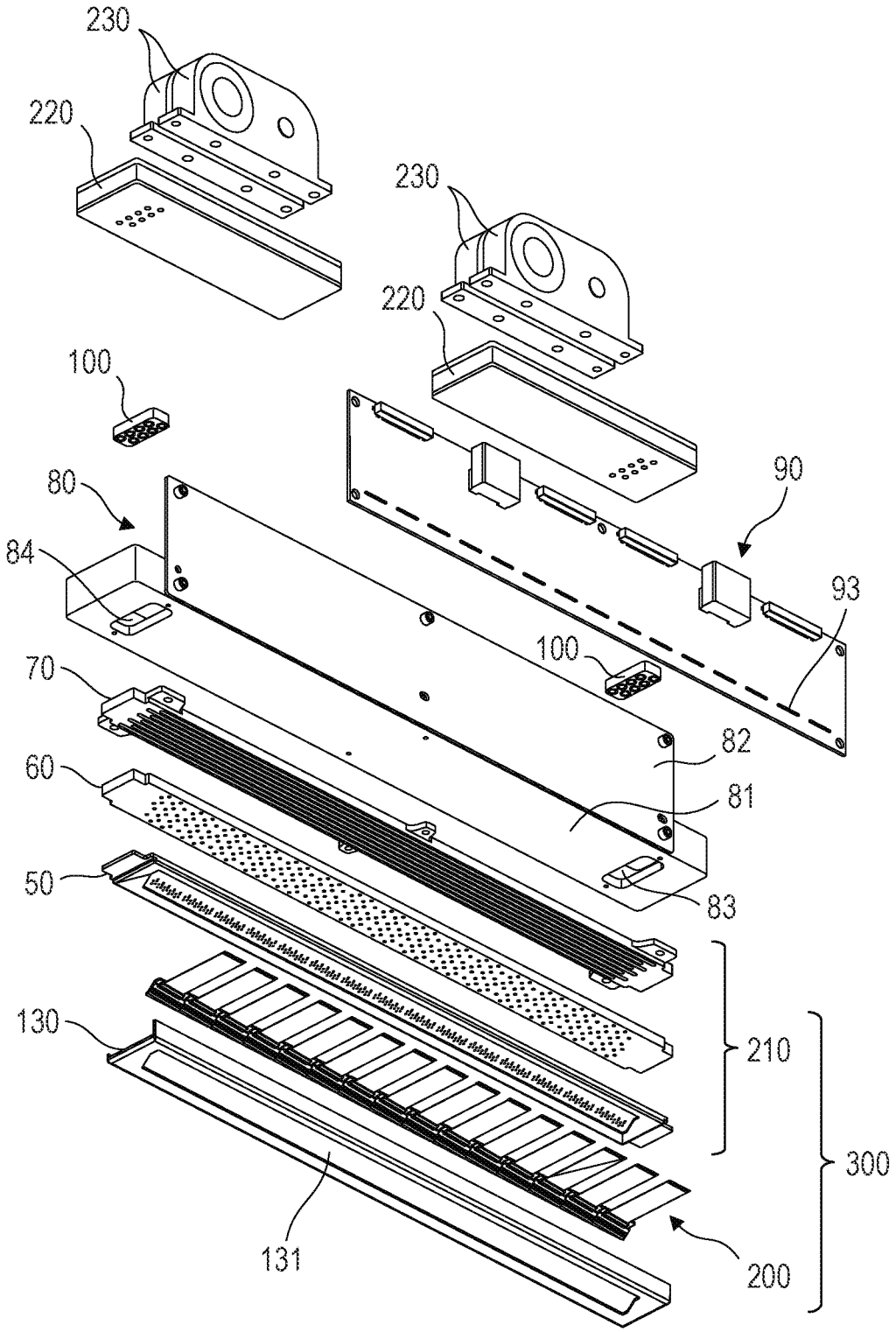
FIG. 4 is an exploded perspective view illustrating the liquid ejection head.

FIG. 4 is an exploded perspective view illustrating the liquid ejection head 3 disassembled into its constituent components and units based on their functions. The liquid ejection unit 300, the liquid supply units 220, and the electric wiring substrate 90 are attached to the housing 80. The liquid supply units 220 are provided with the liquid connection portions 111 (see FIG. 3B). Inside the liquid supply units 220, filters 221 (see FIG. 2) are provided for the four colors which communicate with the openings in the liquid connection portions 111 in order to remove foreign matter in the recording liquids to be supplied. In the illustrated example, one liquid ejection head is provided with two liquid supply units 220 and two negative pressure control units 230. The two liquid supply units 220 are each provided with one filter 221 for two colors. The recording liquids having passed through the filters 221 are supplied to the negative pressure control units 230 arranged on the liquid supply units 220 for the corresponding colors. Each of the negative pressure control units 230 has negative pressure adjustment mechanisms. Valves, spring members, and the like provided inside the negative pressure adjustment mechanisms can operate to significantly attenuate the change in pressure drop in a supply system in the recording apparatus 1000 (the supply system upstream of the liquid ejection head 3) caused by variation in flow rate. Thus, each negative pressure control unit 230 is capable of stabilizing the change in the negative pressure downstream of the negative pressure control unit (the liquid ejection unit 300 side) within a certain range. As described above, each negative pressure control unit 230 for the corresponding colors is provided with two negative pressure adjustment mechanisms, and the control pressures of these two negative pressure adjustment mechanisms are set at different values. The high-pressure side negative pressure adjustment mechanism communicates with the common supply flow paths 211 in the liquid ejection unit 300, and the low-pressure side negative pressure adjustment mechanism communicates with the common collection flow paths 212 in the liquid ejection unit 300.

The housing 80 include a liquid ejection unit support portion 81 and an electric wiring substrate support portion 82, and supports the liquid ejection unit 300 and the electric wiring substrate 90 while also ensuring the stiffness of the liquid ejection head 3. The electric wiring substrate support portion 82 is intended to support the electric wiring substrate 90 and is screwed to the liquid ejection unit support portion 81. The liquid ejection unit support portion 81 serves a role of ensuring the accuracy of the relative positions of the plurality of recording element substrates 10 by correcting warpage and deformation of the liquid ejection unit 300 and, by doing so, prevents stripes and unevenness on a recorded product. For this purpose, the liquid ejection unit support portion 81 preferably has sufficient stiffness, and its material is preferably a metallic material such as stainless steel (SUS) or aluminum or a ceramic such as alumina. Both longitudinal end portions of the liquid ejection unit support portion 81 are provided with openings 83 and 84 in which to insert joint rubber pieces 100. The liquids such as the recording liquids to be supplied from the liquid supply units 220 are guided to a later-described third flow path member 70 forming the liquid ejection unit 300 through the joint rubber pieces 100.

The liquid ejection unit 300 includes a plurality of ejection modules 200 and a flow path forming member 210, and a cover member 130 is attached to the surface of the liquid ejection unit 300 on the recording medium 2 side. As illustrated in FIG. 4, the cover member 130 is a member having a frame-shaped surface provided with a long opening 131, from which the recording element substrate 10 and a sealing material 110 (see FIG. 7A) included in each ejection module 200 are exposed. The frame portion around the opening 131 functions as a surface that contacts a cap member that caps the surface of the liquid ejection head 3 in which the ejection ports are formed during standby for recording. Thus, it is preferred to apply an adhesive, a sealing material, a filling material, or the like along the periphery of the opening 131 to fill irregularities and gaps in the ejection port formation surface of the liquid ejection unit 300 so that a closed space can be formed while the ejection port formation surface is capped.

Next, a configuration of the flow path forming member 210 included in the liquid ejection unit 300 will be described. The flow path forming member 210 is intended to distribute the liquids such as the recording liquids supplied from the liquid supply units 220 to the ejection modules 200 and send the liquids returning from the ejection modules 200 back to the liquid supply units 220. As illustrated in FIG. 4, the flow path forming member 210 includes a first flow path member 50, a second flow path member 60, and the third flow path member 70 stacked and joined in this order and is screwed to the liquid ejection unit support portion 81. This prevents warpage and deformation of the flow path forming member 210.

Figure 5A:
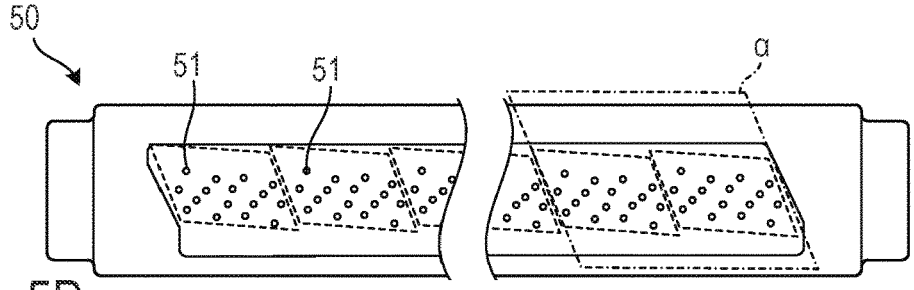
FIG. 5A is a plan view illustrating the surface of a first flow path member 50 on which ejection modules are mounted.
Figure 5B:
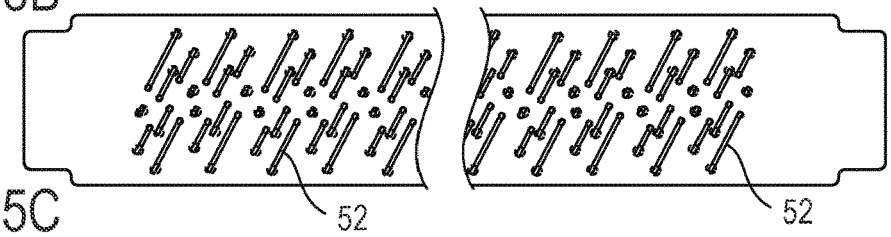
FIG. 5B is a plan view illustrating the surface of the first flow path member 50 that contacts a second flow path member 60.
Figure 5C:
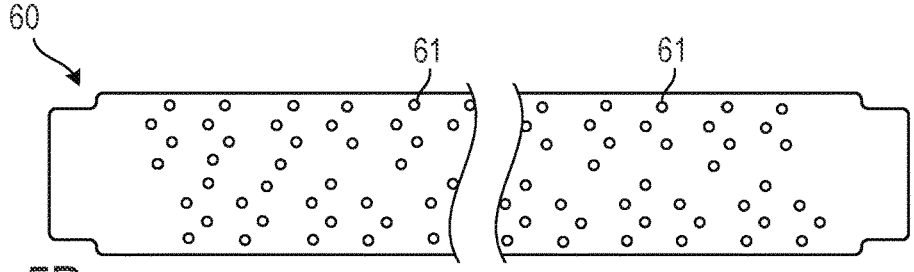
FIG. 5C is a plan view illustrating the surface of the second flow path member 60 that contacts the first flow path member 50.
Figure 5D:
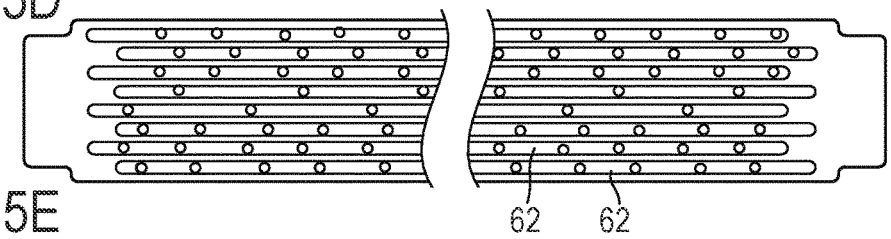
FIG. 5D is a plan view illustrating the surface of the second flow path member 60 that contacts a third flow path member 70.
Figure 5E:
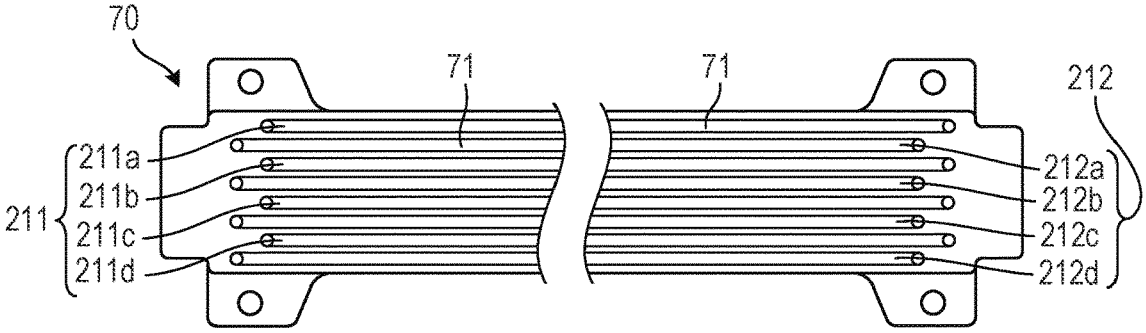
FIG. 5E is a plan view illustrating the surface of the third flow path member 70 that contacts the second flow path member 60.
Figure 5F:
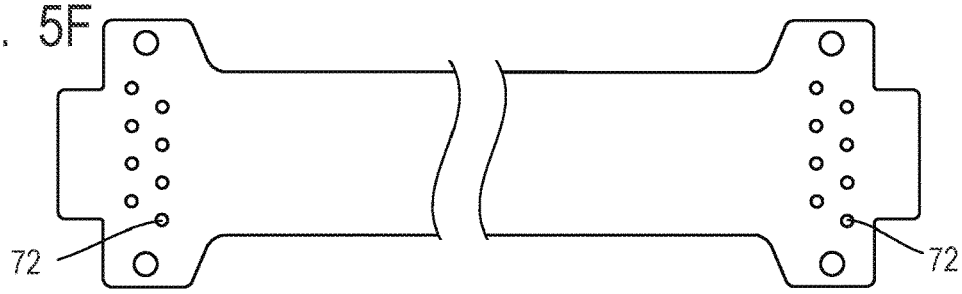
FIG. 5F is a plan view illustrating the surface of the third flow path member 70 that contacts a liquid ejection unit support portion.

FIGS. 5A to 5F illustrate the front and back surfaces of the first to third flow path members 50, 60, and 70. FIG. 5A illustrates the surface of the first flow path member 50 on which the ejection modules 200 are mounted, while FIG. 5F illustrates the surface of the third flow path member 70 which contacts the liquid ejection unit support portion 81. The parallelograms illustrated by the dashed lines in FIG. 5A represent regions where support members 30 of the ejection modules 200 are to be arranged respectively. FIG. 5B illustrates the surface of the first flow path member 50 which contacts the second flow path member 60, while FIG. 5C illustrates the surface of the second flow path member 60 which contacts the first flow path member 50. Similarly, FIG. 5D illustrates the surface of the second flow path member 60 which contacts the third flow path member 70, while FIG. 5E illustrates the surface of the third flow path member 70 that contacts the second flow path member 60. By joining the surfaces of the second flow path member 60 and the third flow path member 70 illustrated in FIGS. 5D and 5E, eight common flow paths extending in the longitudinal direction of these flow path members 60 and 70 are formed by common flow path grooves 62 and 71 formed respectively in the flow path members 60 and 70. As a result, a pair of a common supply flow path 211 and a common collection flow path 212 is formed in the flow path forming member 210 for each of the colors of CMYK. Thus, from the common supply flow path 211 for each color, the corresponding recording liquid is supplied to the liquid ejection head 3 and the recording liquid supplied to the liquid ejection head 3 is collected by the common collection flow path 212 for that color. Communication ports 72 (see FIG. 5F) in the third flow path member 70 communicate with the holes in the joint rubber pieces 100 and fluidly communicate with the liquid supply units 220 (see FIG. 4). A plurality of communication ports 61 are formed in the bottom surfaces of the common flow path grooves 62 in the second flow path member 60 and communicate with one ends of individual flow path grooves 52 in the first flow path member 50. Communication ports 51 are formed in the other ends of the individual flow path grooves 52 in the first flow path member 50, and the individual flow path grooves 52 fluidly communicate with the plurality of ejection modules 200 through the communication ports 51. These individual flow path grooves 52 enable the flow paths to be gathered at a center portion of the first flow path member 50 in the transverse direction.

Note that in the following description, reference signs 211*a* to 211*d* will be used instead of reference sign 211 in the case of distinguishing the common supply flow paths 211 by the colors of the recording liquids, and reference signs 212*a* to 212*d* will be used instead of reference sign 212 in the case of distinguishing the common collection flow paths 212 by the colors. Similarly, reference signs 213*a* to 213*d* will be used instead of reference sign 213 in the case of distinguishing the individual supply flow paths 213 by the colors of the recording liquids, and reference signs 214*a* to 214*d* will be used instead of reference sign 214 in the case of distinguishing the individual collection flow paths 214 by the colors.

It is preferred that the first to third flow path members 50, 60, and 70 forming the flow path forming member 210 have corrosion resistance against the liquids such as the recording liquids and be made of a material with a small coefficient of linear expansion. Examples of the material that can be preferably used include a composite material (a resin material) containing alumina, a liquid crystal polymer (LCP), polyphenylene sulfide (PPS), or a polysulfone (PSF) as a base material with an inorganic filler such as silica fine particles or fibers added thereto. As for the method of forming the flow path forming member 210, the three flow path members 50, 60, and 70 may be stacked and bonded to one another. A joining method using welding may be used in the case where a composite resin material is selected as the material.

Figure 6:
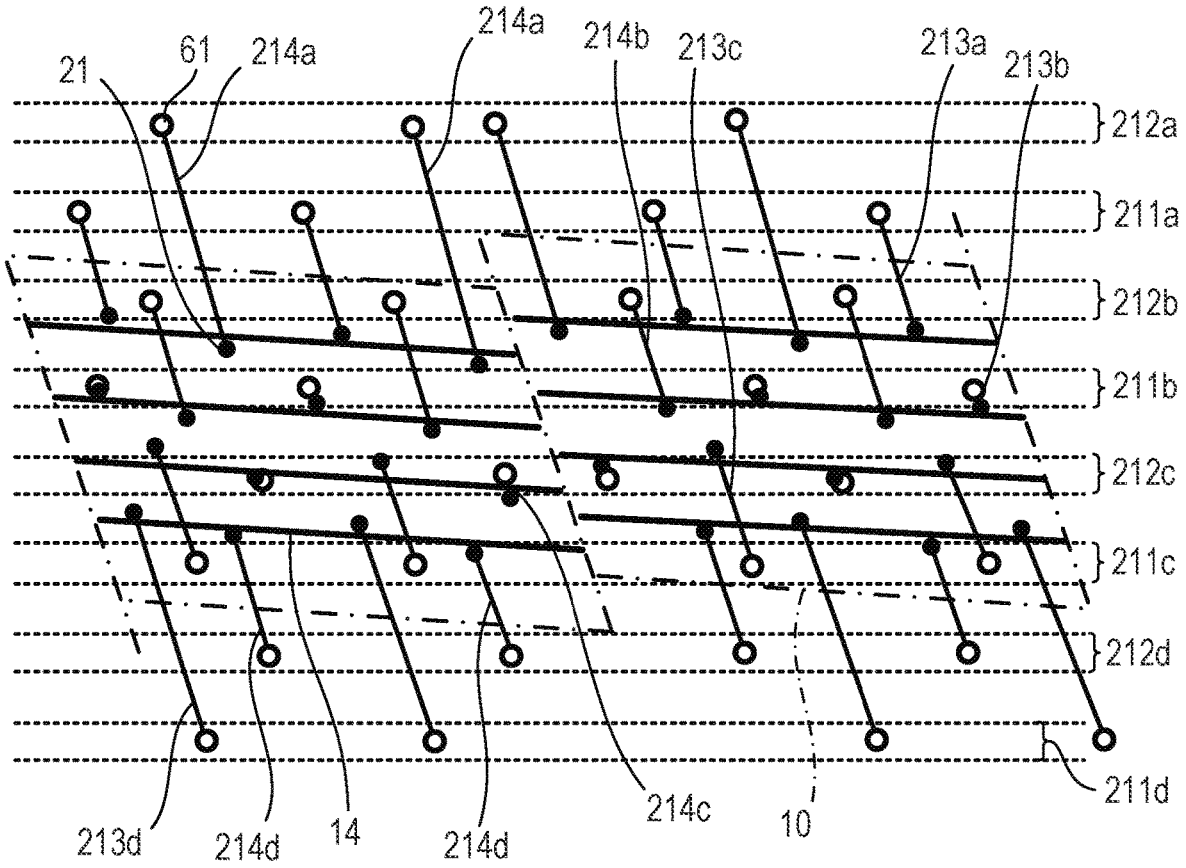
FIG. 6 is a transparent view illustrating how flow paths are connected.

FIG. 6 illustrates the part in FIG. 5A surrounded by the long dashed short dashed line a, and is a transparent view in which some flow paths in the flow path forming member 210 are enlarged and illustrated from the side of the first flow path member 50 with the surface where the ejection modules 200 are mounted. How the flow paths in the flow path forming member 210 are connected will be described using FIG. 6. In FIG. 6, the regions surrounded by the long dashed short dashed lines correspond to the positions where recording element substrates 10 are arranged, and the bold solid lines depicted in each recording element substrate 10 conceptually represent ejection port arrays 14. In the flow path forming member 210, four common supply flow paths 211 for the four colors and four common collection flow paths 212 for the four colors extending in the longitudinal direction of the liquid ejection head 3 are provided so as to be parallel to each other and alternately arranged. Here, the common collection flow path 212*a*, common supply flow path 211*a*, common collection flow path 212*b*, common supply flow path 211*b*, common collection flow path 212*c*, common supply flow path 211*c*, common collection flow path 212*d*, and common supply flow path 211*d* are arranged in this order from the illustrated upper end. The plurality of individual supply flow paths 213*a* to 213*d* formed by some individual flow path grooves 52 are connected to the common supply flow paths 211*a* to 211*d* for the four colors through some communication ports 61. Also, the plurality of individual collection flow paths 214*a* to 214*d* formed by some individual flow path grooves 52 are connected to the common collection flow paths 212*a* to 212*d* for the four colors through some communication ports 61. In each of the individual supply flow paths 213*a* to 213*d* and the individual collection flow paths 214*a* to 214*d*, the end opposite to the end connected to the communication port 61 is an end that communicates with an opening 21 in a lid member 20 through a liquid communication port 31 in a support member 30. In FIG. 6, the position of each communication port 61 is conceptually illustrated with an outlined circle, and the position of each opening 21 is conceptually illustrated with a solid circle. With such a flow path configuration, the recording liquids can be gathered at the recording element substrates 10 provided at positions corresponding to a center portion of the flow path forming member 210 from the common supply flow paths 211 through the individual supply flow paths 213. Moreover, the recording liquids can be collected from the recording element substrates 10 into the common collection flow paths 212 through the individual collection flow paths 214.

The common supply flow path 211 for each color is connected to the high-pressure side negative pressure adjustment mechanism of the negative pressure control unit 230 for that color through the corresponding liquid supply unit 220. Similarly, the common collection flow path 212 for each color is connected to the low-pressure side negative pressure adjustment mechanism of the negative pressure control unit 230 for that color through the corresponding liquid supply unit 220. These pressure adjustment mechanisms in the negative pressure control units 230 generate a differential pressure (pressure difference) between the common supply flow paths 211 and the common collection flow paths 212. Accordingly, inside the liquid ejection head 3 with the flow paths connected as illustrated in FIG. 6, flows of the recording liquids are generated such that the recording liquid of each color flows through the common supply flow path 211, the individual supply flow paths 213, the recording element substrates 10, the individual collection flow paths 214, and the common collection flow path 212 sequentially in this order.

(Description of Ejection Modules)

Figure 7A:
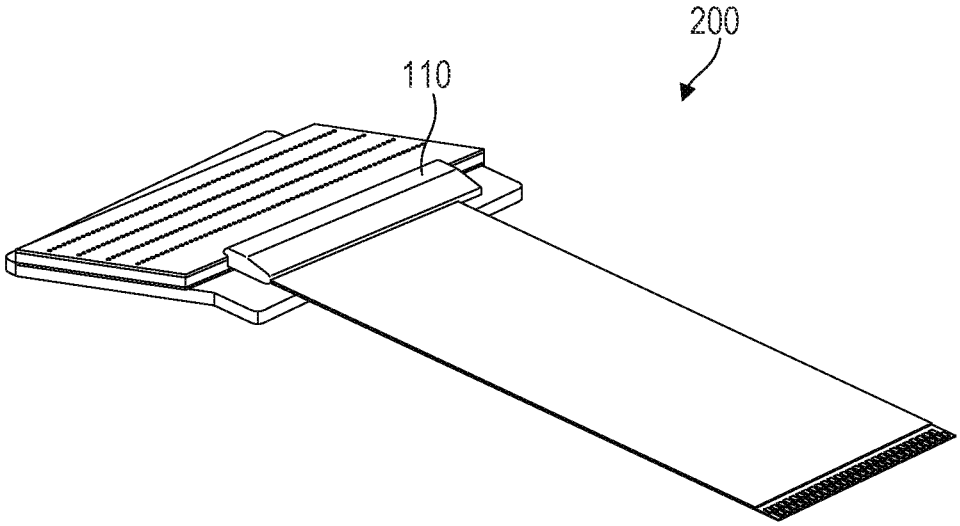
FIG. 7A is a perspective view illustrating an ejection module.
Figure 7B:
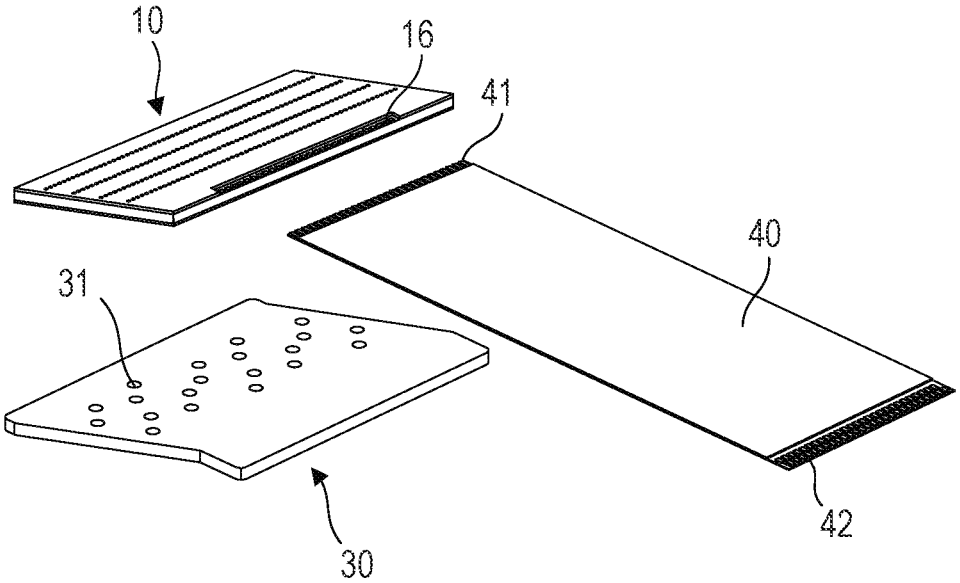
FIG. 7B is an exploded view thereof.

Next, the ejection modules 200 will be described. FIG. 7A is a perspective view of an ejection module 200, and FIG. 7B is an exploded view thereof. In a method of manufacturing the ejection module 200, firstly, the recording element substrate 10 and the flexible wiring substrate 40 are bonded onto the support member 30 provided with the liquid communication ports 31 in advance. Then, terminals 16 on the recording element substrate 10 and terminals 41 on the flexible wiring substrate 40 are electrically connected to each other by wire bonding, and thereafter the wire-bonded portions (electrically connected portions) are covered with the sealing material 110 to be sealed. Terminals 42 on the flexible wiring substrate 40 opposite to the recording element substrate 10 are electrically connected to connection terminals 93 (see FIG. 4) on the electric wiring substrate 90. The support member 30 is a support that supports the recording element substrate 10 and also is a flow path communication member through which to bring the recording element substrate 10 and the flow path forming member 210 into fluid communication with each other. For this reason, a support member that has high flatness and can be joined sufficiently reliably to the recording element substrate is preferred. The material of the support member 30 is preferably alumina or a resin material, for example.

(Description of Structure of Recording Element Substrates)

Figure 8A:
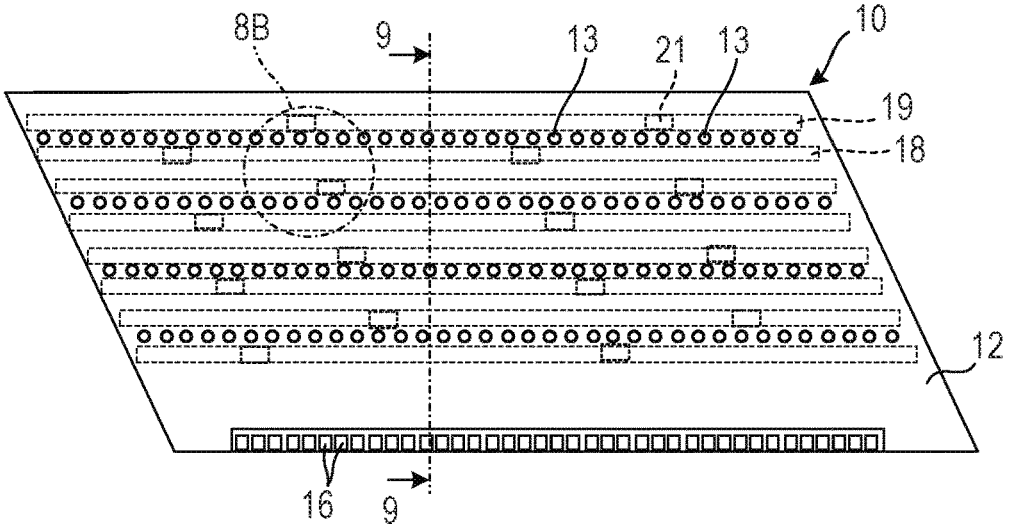
FIG. 8A is a plan view of the surface of a recording element substrate in which ejection ports are formed.
Figure 8B:
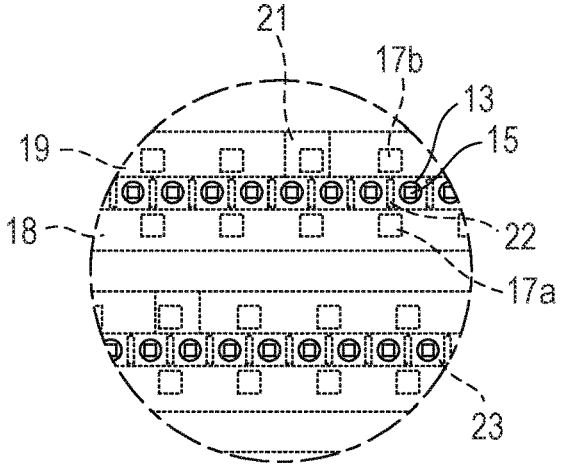
FIG. 8B is an enlarged view of the part indicated by the region 8B in FIG. 8A.
Figure 8C:
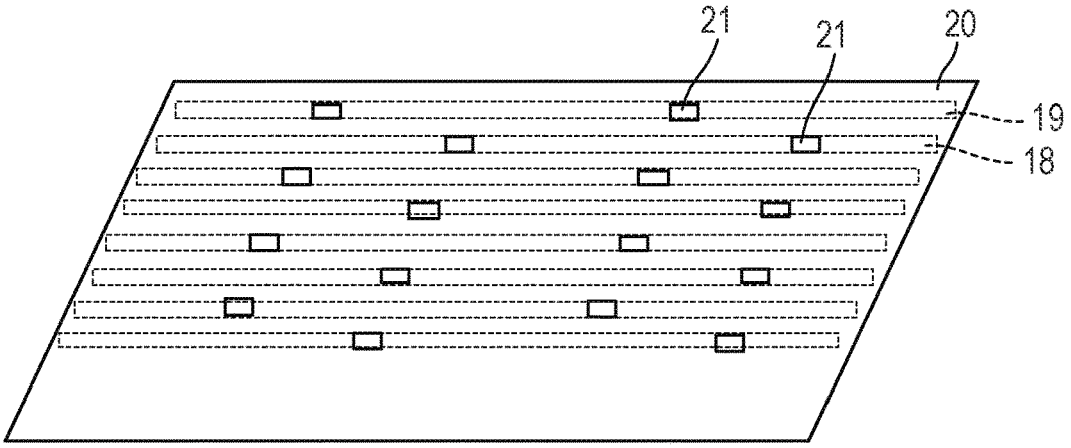
FIG. 8C is a plan view of the side being the back surface in FIG. 8A.

Next, a configuration of the recording element substrates 10 will be described. FIG. 8A is a plan view of the surface of a recording element substrate 10 in which ejection ports 13 are formed, FIG. 8B is an enlarged view of the part indicated by the region 8B in FIG. 8A, and FIG. 8C is a plan view of the side being the back surface in FIG. 8A. As illustrated in FIG. 8A, the recording element substrate 10 has an ejection port forming member 12 in which a plurality of ejection ports 13 are formed in the form of arrays. In the ejection port forming member 12, four ejection port arrays corresponding respectively to the four colors of CMYK, which are the colors of the recording liquids, are formed. Note that the direction of extension of the ejection port arrays each being a plurality of arrayed ejection ports 13 will be hereinafter referred to as "ejection port array direction". As illustrated in FIG. 8B, at each of positions corresponding to the ejection ports 13, a recording element 15 is arranged as a heat generation element that generates a bubble in the liquid by means of thermal energy. Pressure chambers 23 each including a recording element 15 therein are defined by partition walls 22. The recording elements 15 are electrically connected to the terminals 16 illustrated in FIG. 8A by electric wirings (not illustrated) provided in the recording element substrate 10. The recording elements 15 generate heat based on a pulse signal inputted from the controller in the recording apparatus 1000 via the electric wiring substrate 90 (see FIG. 4) and the corresponding flexible wiring substrate 40 (see FIGS. 7A and 7B) to thereby boil the liquid in the respective pressure chambers 23. The force of bubbles generated by this boiling ejects the liquid from the ejection ports 13. As illustrated in FIG. 8B, along each ejection port array, there are a liquid supply channel 18 extending on one side and a liquid collection channel 19 extending on the other side. The liquid supply channel 18 and the liquid collection channel 19 are flow paths provided in the recording element substrate 10 and extending in the ejection port array direction, and communicate with the corresponding ejection ports 13 through supply ports 17*a* and collection ports 17*b*, respectively.

As illustrated in FIG. 8C, a lid member 20 of a sheet shape is laminated on the back side of the recording element substrate 10 opposite to the surface where the ejection ports 13 are formed. The lid member 20 is provided with a plurality of openings 21 communicating with the liquid supply channels 18 and a plurality of openings 21 communicating with the liquid collection channels 19. In one example, the number of openings 21 communicating with the liquid supply channels 18 and the number of openings 21 communicating with the liquid collection channels 19 are the same. In the example illustrated here, the lid member 20 is provided with two openings 21 for one liquid supply channel 18 and two openings 21 for one liquid collection channel 19. As illustrated in FIG. 8B, the openings 21 in the lid member 20 communicate with a plurality of corresponding communication ports 51 illustrated in FIG. 5A, respectively. The lid member 20 is preferably made of a material having sufficient corrosion resistance against the liquids such as the recording liquids. Moreover, the opening shapes and positions of the openings 21 are required to be highly accurate in view of preventing mixing of the colors. It is therefore preferred to use a photosensitive resin material or a silicon plate as the material of the lid member 20 and provide the openings 21 by a photolithography process. As described above, the lid member 20 converts the flow path pitch by means of the openings 21 and, considering the pressure drop, is desirably thin and desirably formed of a film-shaped member.

Figure 9:
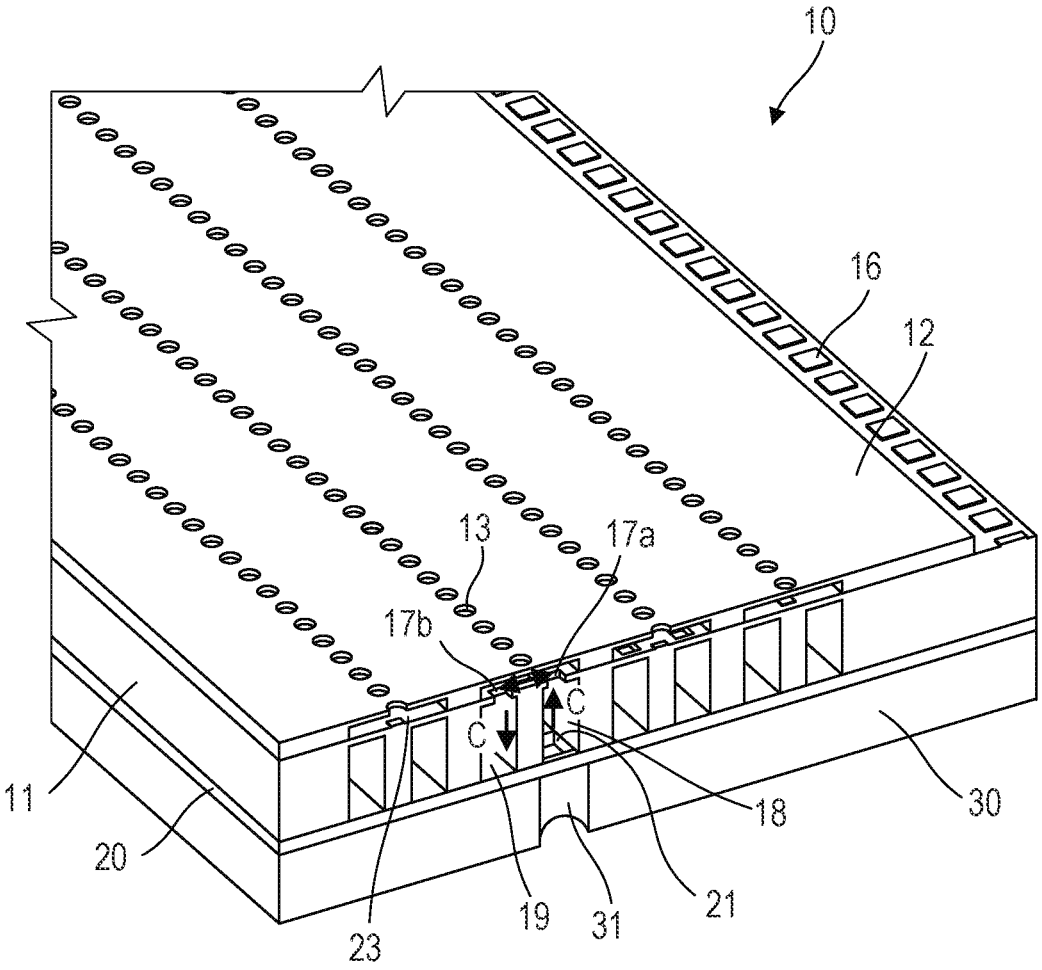
FIG. 9 is a partially cross-sectional perspective view illustrating a recording element substrate in the liquid ejection head.

FIG. 9 illustrates a cross-section of the recording element substrate 10 and the lid member 20 taken along the 9-9 line in FIG. 8A. In FIG. 9, the support member 30, which is not illustrated in FIG. 8A, is depicted as well. Here, the flows of the liquids inside the recording element substrate 10 will be described. The lid member 20 functions as a lid that forms a part of the walls of the liquid supply channels 18 and the liquid collection channels 19 formed in a base plate 11 of the recording element substrate 10. In the recording element substrate 10, the ejection port forming member 12, which is made of a photosensitive resin, is laminated on one surface of the base plate 11, which is formed of a silicon (Si) substrate, while the lid member 20 is joined to the other surface of the base plate 11. The recording elements 15 are formed in the one surface of the base plate 11 (see FIG. 8B) while grooves extending in the ejection port array direction and forming the liquid supply channels 18 and the liquid collection channels 19 are formed in the other surface. The lid member 20 is arranged on the surface of the base plate 11 that is laminated on the support member 30 while covering the liquid supply channels 18 and the liquid collection channels 19. The liquid supply channels 18 and the liquid collection channels 19 formed by the base plate 11 and the lid member 20 are connected respectively to the common supply flow paths 211 and the common collection flow paths 212 in the flow path forming member 210, and a differential pressure is present between the liquid supply channels 18 and the liquid collection channels 19. In the first flow path member 50, the individual supply flow paths 213 and the individual collection flow paths 214 are formed. The individual supply flow paths 213 connect the liquid supply channels 18 and the common supply flow paths 211, while the individual collection flow paths 214 connect the liquid collection channels 19 and the common collection flow paths 212. At each ejection port not performing an ejection operation while recording is performed by ejecting the liquids from a plurality of ejection ports 13 in the liquid ejection head 3, the above differential pressure causes the liquid in the liquid supply channel 18 to flow to the liquid collection channel 19 through the supply port 17*a*, the pressure chamber 23, and the collection port 17*b* sequentially in this order. This flow is illustrated by the arrows C in FIG. 9. With this flow, the recording liquid which is present in each ejection port 13 and pressure chamber 23 not involved in the recording and whose viscosity has increased due to evaporation of its solvent from the ejection port 13 can be collected into the liquid collection channel 19, and bubbles, foreign matter, and the like can be collected into the liquid collection channel 19 as well. The flow also makes it possible to prevent an increase in the viscosity of the recording liquid in the ejection port 13 and pressure chamber 23. The liquid such as the recording liquid collected in the liquid collection channel 19 passes through the corresponding openings 21 in the lid member 20 and the corresponding liquid communication ports 31 (see FIG. 7B) in the support member 30, and is collected sequentially through the corresponding communication ports 51, individual collection flow paths 214, and common collection flow path 212 in the flow path forming member 210. This collected liquid is finally collected into the corresponding supply channel in the recording apparatus 1000.

In sum, the liquids such as the recording liquids supplied from the main body of the recording apparatus 1000 to the liquid ejection head 3 are supplied and collected by flowing in the following order. The liquids firstly flow into the liquid ejection head 3 from the liquid connection portions 111 of the liquid supply unit 220. These liquids are then supplied sequentially to the joint rubber pieces 100, some communication ports 72 and common flow path grooves 71 provided in the third flow path member 70, some common flow path grooves 62 and communication ports 61 provided in the second flow path member 60, and some individual flow path grooves 52 and communication ports 51 provided in the first flow path member 50. Thereafter, the liquids are supplied to the pressure chambers 23 sequentially through some liquid communication ports 31 provided in the support members 30, some openings 21 provided in the lid members 20, the liquid supply channels 18 and supply ports 17*a* provided in the base plates 11. The portions of the liquids supplied to the pressure chambers 23 but not ejected from the ejection ports 13 flow sequentially through the collection ports 17*b* and liquid collection channels 19 provided in the base plates 11, some openings 21 provided in the lid members 20, and some liquid communication ports 31 provided in the support members 30. Thereafter, the liquids flow sequentially through some communication ports 51 and individual flow path grooves 52 provided in the first flow path member 50, some communication ports 61 and common flow path grooves 62 provided in the second flow path member 60, some common flow path grooves 71 and communication ports 72 provided in the third flow path member 70, and the joint rubber pieces 100. The liquids then flow out of the liquid ejection head 3 through the liquid connection portions 111 provided in the liquid supply unit 220. In the circulation configuration illustrated in FIG. 2, the liquids having flowed in from the liquid connection portions 111 pass through the negative pressure control units 230 and are then supplied to the joint rubber pieces 100.

Note that the liquids having flowed in from one ends of the common supply flow paths 211 in the liquid ejection unit 300 are not entirely supplied to the pressure chambers 23 through the individual supply flow paths 213. As illustrated in FIG. 2, there are portions of the liquids that do not flow into the individual supply flow paths 213 but flow into the liquid supply units 220 from the other ends of the common supply flow paths 211. By including these channels that allow the liquids to flow without passing through the recording element substrates 10, it is possible to prevent backflow of the circulating liquid flows even in the case of including recording element substrates 10 with small flow paths in which the flow resistance is large. Since the liquid ejection head 3 is capable of preventing an increase in the viscosity of the liquids in and around the pressure chambers and the ejection ports as described above, it is possible to prevent irregular ejection and ejection failures and therefore perform recording with high image quality.

(Description of Positional Relationship Between Recording Element Substrates)

Figure 10:
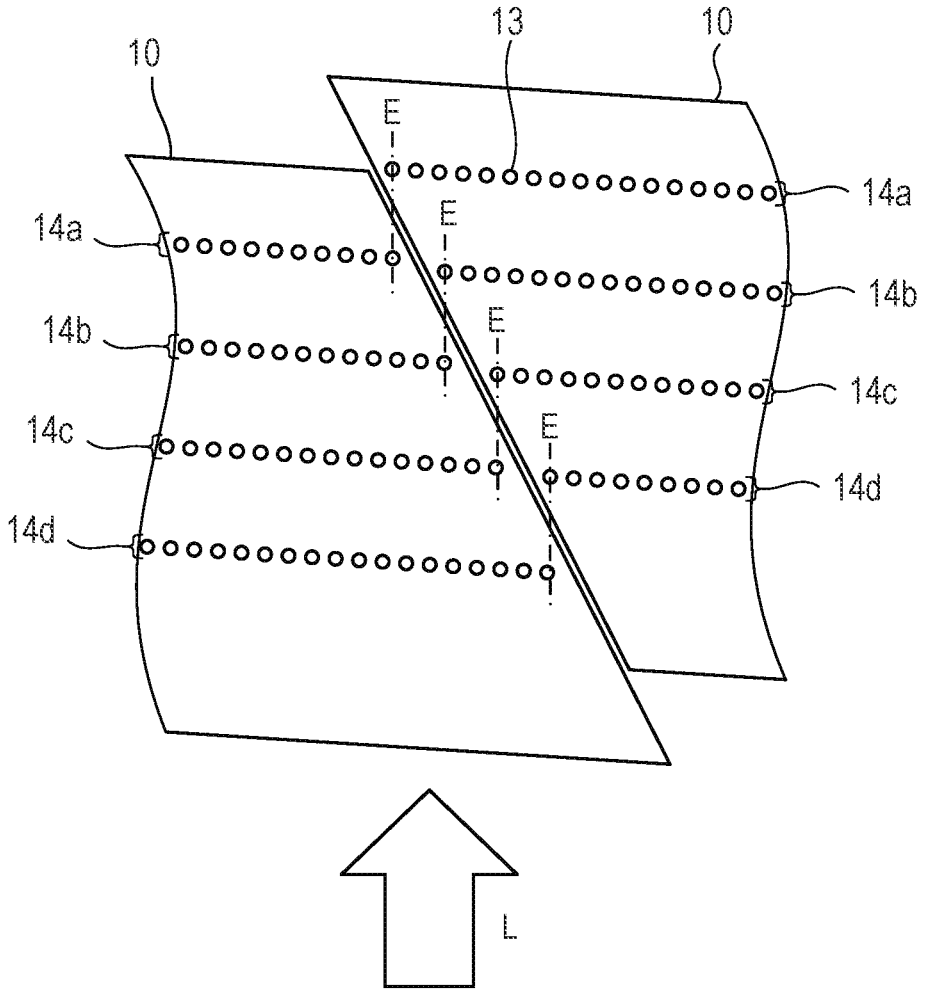
FIG. 10 is a plan view illustrating adjacent recording element substrates.

As described above, the liquid ejection head 3 includes a plurality of ejection modules 200. FIG. 10 is a plan view in which adjacent portions of the recording element substrates 10 in two adjacent ejection modules 200 are enlarged and illustrated. As illustrated in FIG. 10, substantially parallelogramatic recording element substrates 10 are used here. In each recording element substrate 10, ejection port arrays 14*a* to 14*d* for the four colors being arrays of ejection ports 13 are arranged so as to be tilted at a certain angle with respect to the longitudinal direction of the liquid ejection head 3. Also, at the adjacent portions of the recording element substrates 10, at least one ejection port 13 in each ejection port array coincides with that in the other ejection port array in the conveyance direction of the recording medium 2 indicated by the arrow L illustrated in FIG. 10. In the relationship illustrated in FIG. 10, the two ejection ports 13 on each line E coincide with each other. With such an arrangement, even if a recording element substrate 10 is somewhat displaced from its predetermined position, a black stripe or a white void portion in a recorded image can be rendered unnoticeable by controlling the driving of the coinciding ejection ports. Even in the case of placing the plurality of recording element substrates 10 in an in-line arrangement instead of a staggered arrangement, a configuration as illustrated in FIG. 10 can be employed to address a black stripe or a white void at the joint portion between the recording element substrates 10 while keeping the liquid ejection head 3 from becoming large in the conveyance direction of the recording medium. Note that while the profile of the recording element substrates 10 here is a substantially parallelogramatic shape, the profile is not limited to it. The configuration of the present disclosure is preferably applicable also to cases of using recording element substrates 10 of, for example, a rectangular shape, a trapezoidal shape, or another shape.

A liquid ejection apparatus to which the present disclosure is applicable has been described above by taking the recording apparatus 1000, which is an inkjet recording apparatus, as an example. In the above-described liquid ejection head 3, a gap in temperature distribution may appear between the recording element substrates 10 of adjacent ejection modules 200 in the case of using completely identical ejection modules 200. The gap in temperature distribution appearing between the recording element substrates 10 causes unevenness such as density unevenness in a recorded image when the liquid ejection head 3 is an inkjet print head, for example. In the following, a description will be given of liquid ejection heads in specific embodiments of the present disclosure in which a gap in temperature distribution is prevented from appearing between adjacent recording element substrates 10.

(Concept of the Present Disclosure)

Figure 11:
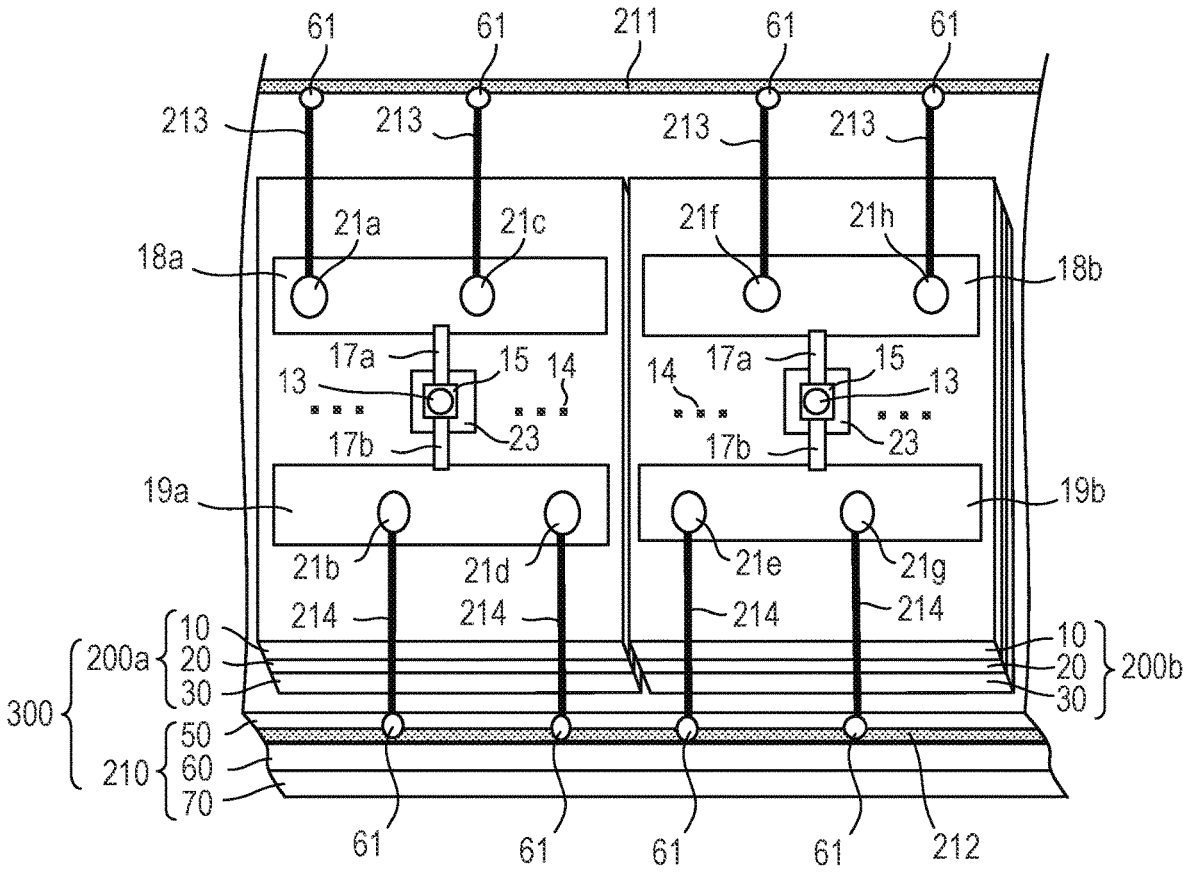
FIG. 11 is a diagram illustrating the relationship between adjacent ejection modules with respect to flow paths and openings.

FIG. 11 is a schematic perspective view illustrating the concept of the configuration of a liquid ejection unit 300 in a liquid ejection head 3 based on the present disclosure. In this view, two adjacent ejection modules 200 are designated as ejection modules 200*a* and 200*b*, respectively, in order to distinguish them. The liquid ejection unit 300 is formed by attaching a plurality of ejection modules 200, each obtained by laminating a recording element substrate 10 and a support member 30, to a flow path forming member 210. Here, the ejection modules 200 are arrayed on the flow path forming member 210 such that their ejection ports 13 are arranged in the form of an array along the longitudinal direction of the flow path forming member 210. Each recording element substrate 10 is laminated on the support member 30 with its lid member 20 therebetween. In the flow path forming member 210, a first flow path member 50, a second flow path member 60, and a third flow path member 70 are laminated on top of one another.

As described above, the recording element substrate 10 forming one ejection module 200 is provided with a plurality of ejection ports 13, and these are arranged in the form of an array to form an ejection port array 14. For each ejection port 13, the recording element substrate 10 is provided with a recording element 15 arranged to face the ejection port 13 and used to eject a liquid from the ejection port 13, and a pressure chamber 23 where the ejection port 13 and the recording element 15 are provided. Further, in the recording element substrate 10, supply ports 17*a* through which to supply the liquid to the respective pressure chambers 23 and collection ports 17*b* through which to move and collect the portion of the liquid having passed through the pressure chambers 23 without being ejected from the pressure chambers 23 are coupled to each other. The plurality of supply ports 17*a* provided in one recording element substrate 10 communicate with one liquid supply channel 18, and the plurality of collection ports 17*b* provided in one recording element substrate 10 communicate with one liquid collection channel 19. In the example illustrated in FIG. 11, the liquid is supplied to the liquid supply channel 18 in one ejection module 200 through two individual supply flow paths 213 provided in the flow path forming member 210. The individual supply flow paths 213 are connected in common to a common supply flow path 211 and the liquid is supplied from it. On the other hand, from the liquid collection channel 19 in one ejection module 200, the liquid is collected through two individual collection flow paths 214 provided in the flow path forming member 210. The liquid is then collected through a common collection flow path 212 to which the individual collection flow paths 214 are connected in common. In sum, the liquid supplied from the common supply flow path 211 is supplied to the individual supply flow paths 213 through openings 61 at two positions, and then supplied from the individual supply flow paths 213 to some openings in the first flow path member 50 (communication ports 51). Further, this liquid is supplied from the communication ports 51 to the liquid supply channel 18 through some openings in the support member 30 (liquid communication ports 31) and some openings 21 in the lid member 20. The liquid supplied to the liquid supply channel 18 is supplied to the pressure chambers 23 through the supply ports 17*a* and ejected from the ejection ports 13 in response to operation of the recording elements 15. Also, the portion of the liquid having passed through the pressure chambers 23 without being used in the recording and discharged from the collection ports 17*b* are collected into the liquid collection channel 19. Further, this liquid passes through some openings 21 in the lid member 20, some openings in the support member 30, and some openings in the first flow path member 50 and then through the individual collection flow paths 214. Thereafter, the liquid is collected into the common collection flow path 212 through openings 61 at two positions. Such a liquid flow from the common supply flow path 211 to the common collection flow path 212 may be expressed as circulative supply. In FIG. 11, the openings 21 formed in the lid members 20 are denoted by reference signs 21*a* to 21*h* in order to distinguish them.

In the liquid ejection head 3 based on the present disclosure, openings 21 in the adjacent ejection modules 200*a* and 200*b* under an equivalent temperature condition are arranged adjacent to each other so as to minimize the temperature difference between the adjacent regions of the ejection modules 200. For example, in the configuration illustrated in FIG. 11, in which the ejection modules 200*a* and 200*b* are assumed as being arranged side by side in this order from the left side of FIG. 11, the ejection modules 200*a* and 200*b* are respectively provided with liquid supply channels 18*a* and 18*b* and also with liquid collection channels 19*a* and 19*b*. The liquid supply channels 18*a* and 18*b* are identical in arrangement, and the liquid collection channels 19*a* and 19*b* are identical in arrangement as well. Specifically, the liquid supply channels 18*a* and 18*b* are disposed in this order from the left side of FIG. 11 on one side of the ejection port arrays 14 (the upper side in FIG. 11). Similarly, the liquid collection channels 19*a* and 19*b* are disposed in this order from the left side of FIG. 11 on the other side of the ejection port arrays 14 (the lower side in FIG. 11). The openings 21*a* to 21*h* disposed in the liquid supply channels 18*a* and 18*b* and the liquid collection channels 19*a* and 19*b* are arranged to be line-symmetric with respect to the boundary region between the adjacent ejection modules 200*a* and 200*b* so that openings 21 under an equivalent temperature condition lie adjacent to each other.

Specifically, the openings 21*a* to 21*h* are arranged to form two arrays in the ejection port array direction and are also arranged to be staggered in this order. Of these two arrays, one array corresponds to the liquid supply channels 18*a* and 18*b* on the upper side of FIG. 11 while the other array corresponds to the liquid collection channels 19*a* and 19*b* on the lower side of FIG. 11. Thus, in the ejection module 200*a* on the left side of FIG. 11, the opening 21*a* connected to the liquid supply channel 18*a*, the opening 21*b* connected to the liquid collection channel 19*a*, the opening 21*c* connected to the liquid supply channel 18*a*, and the opening 21*d* connected to the liquid collection channel 19*a* are arranged to be staggered in this order from the left side of FIG. 11. Similarly, in the ejection module 200*b* on the right side of FIG. 11, the opening 21*e* connected to the liquid collection channel 19*b*, the opening 21*f* connected to the liquid supply channel 18*b*, the opening 21*g* connected to the liquid collection channel 19*b*, and the opening 21*h* connected to the liquid supply channel 18*b* are arranged to be staggered in this order from the left side of FIG. 11. Here, focusing on the liquid communication ports 31 provided in each support member 30, the order of arrangement of the liquid communication ports 31 is considered along the ejection port array direction (here the direction from the left side to the right side of FIG. 11) and therefore the longitudinal direction of the flow path forming member 210. In the left ejection module 200*a*, the liquid communication ports 31 at the odd numbered positions are the supply-side liquid communication ports while the liquid communication ports 31 at the even numbered positions are the collection-side liquid communication ports. In the right ejection module 200*b*, on the other hand, the liquid communication ports 31 at the odd numbered positions are the collection-side liquid communication ports while the liquid communication ports 31 at the even numbered positions are the supply-side liquid communication ports. Note that in the configuration illustrated in FIG. 11, the adjacent ejection modules 200*a* and 200*b* are line-symmetric with respect to the boundary region between their adjacent portions but do not necessarily have to be line-symmetric as long as the temperature difference between them can be an allowable value or less.

In the above configuration, the adjacent ejection modules 200*a* and 200*b* are configured such that the collection-side openings 21*d* and 21*e*, which have similar characteristics in terms of the temperature condition for the collection through the pressure chamber 23, are the closest pair. That is, in the two adjacent ejection modules 200*a* and 200*b*, their openings 21 are paired and arranged so as to minimize the temperature difference. Here, in the adjacent ejection modules 200*a* and 200*b*, a pair of collection-side openings 21 is the closest pair, but a pair of supply-side openings 21 may be the closest pair. The supply-side openings 21 too have similar characteristics in terms of the temperature condition for the supply to the pressure chamber 23. By forming the two ejection modules 200*a* and 200*b* configured as above as a pair and arranging a plurality of such pairs in series, it is possible to form a so-called long liquid ejection head 3 in which a plurality of ejection modules 200 are arrayed.

In such a configuration, the ejection modules 200*a* and 200*b* differ in the arrangement of the openings 21*a* and 21*c* and the openings 21*f* and 21*h* disposed in the liquid supply channels 18*a* and 18*b* and in the arrangement of the openings 21*b* and 21*d* and the openings 21*e* and 21*g* disposed in the liquid collection channels 19*a* and 19*b*. It is therefore necessary to prepare two types of ejection modules 200. Specifically, since the openings 21 in the lid members 20 differ in arrangement, two types of recording element substrates 10 are needed. Moreover, since the liquid communication ports 31 in the support members 30 communicate with the openings 21 in the respective lid members 20, two types of support members 30 differing in the positions of the liquid communication ports 31 are needed. Note that the liquid ejection head 3 based on the present disclosure can also use recording element substrates 10 having the same shape and structure for each adjacent pair of ejection modules 200*a* and 200*b*. An example of this will be described in a second embodiment to be discussed later. In each adjacent pair ejection modules 200*a* and 200*b*, not only the recording element substrates 10 can have a common shape but also the support members 30 can have a common shape. An example of this will be described in a third embodiment.

First Embodiment

Figure 12A:
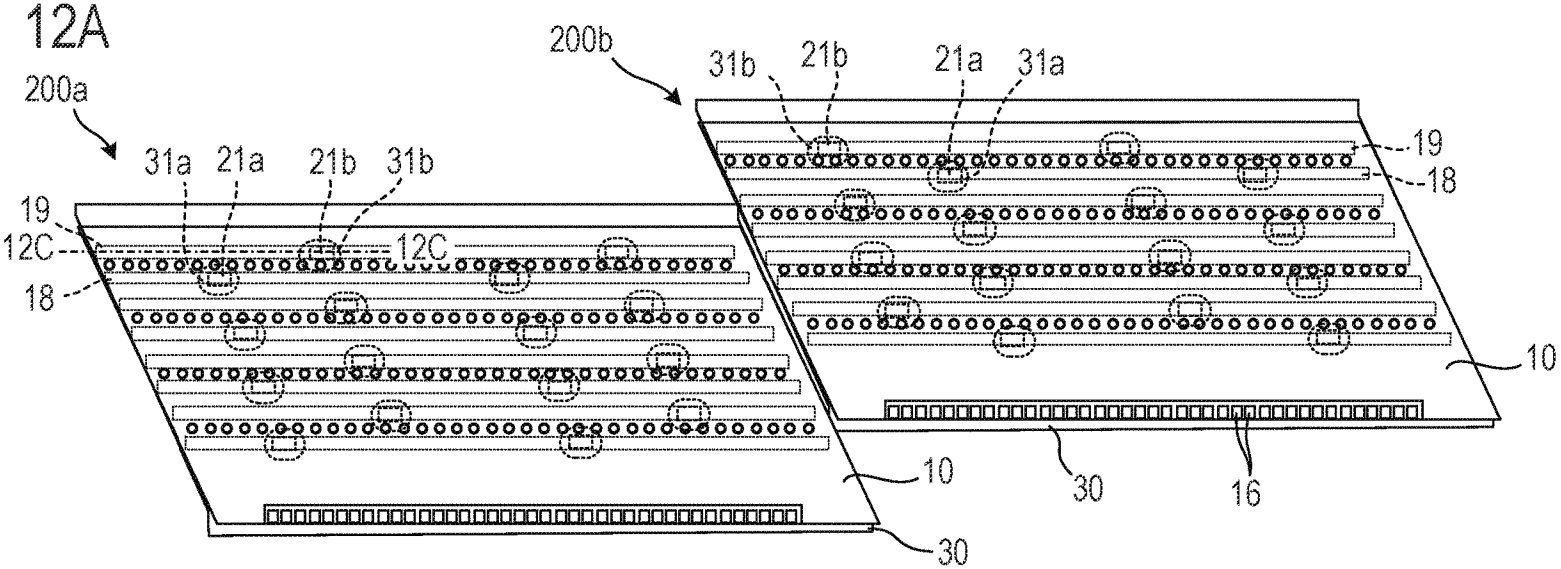
FIG. 12A is a transparent view of the relationship between adjacent ejection modules in a first embodiment as seen from their recording element substrate side.
Figure 12B:
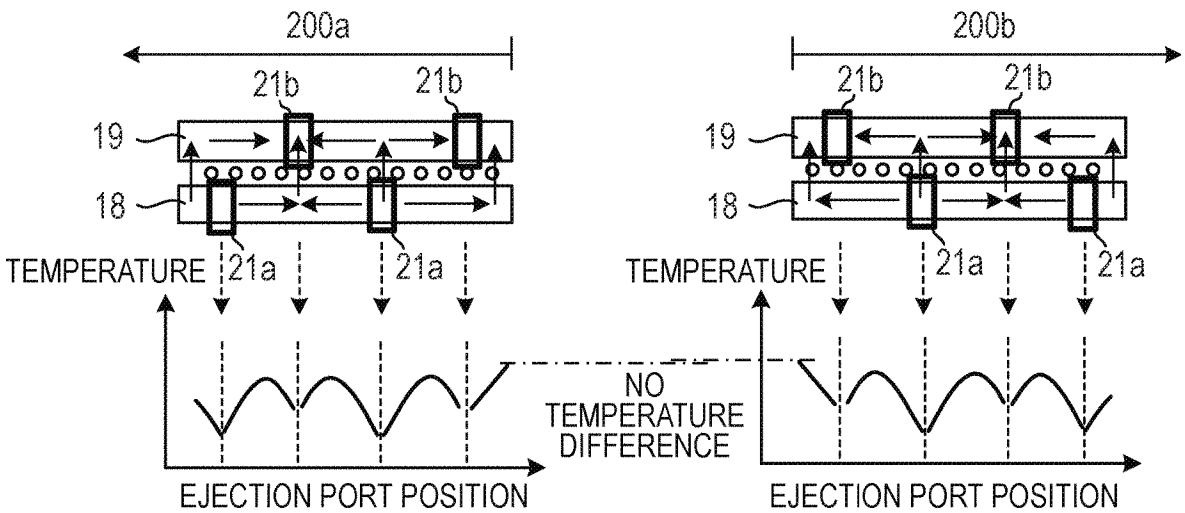
FIG. 12B is a schematic diagram illustrating the relationship between the adjacent ejection modules with respect to the arrangement of openings and the temperature profile in the recording element substrate along one ejection port array in the liquid ejection head.
Figure 12C:
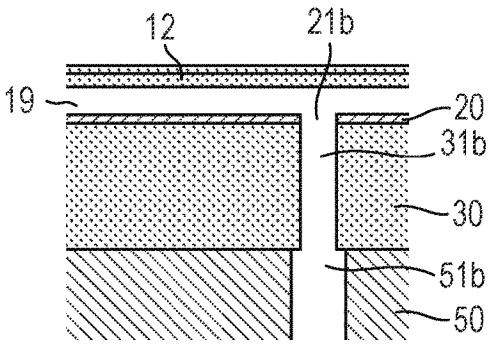
FIG. 12C is a cross-sectional view illustrating a cross section taken along the 12C-12C line in FIG. 12A.

FIGS. 12A to 12C explain a liquid ejection head 3 in a first embodiment of the present disclosure. As described above, the present disclosure is characterized by the arrangement of the openings 21 provided in the liquid supply channels 18 and the liquid collection channels 19 in each adjacent pair of ejection modules 200*a* and 200*b*. The first embodiment is a specific version of the configuration described using FIG. 11. FIG. 12A is a transparent view of adjacent ejection modules 200*a* and 200*b* in the first embodiment as seen from their recording element substrate 10 side, and illustrates the arrangement of openings 21. The ejection modules 200*a* and 200*b* are each formed by arranging a recording element substrate 10 and a flexible wiring substrate 40 on a support member 30. However, the flexible wiring substrate 40 is not illustrated in FIG. 12A for the sake of explanation. FIG. 12B illustrates the relationship between the arrangements of the openings 21 in the adjacent ejection modules 200*a* and 200*b* and the temperature profiles in their recording element substrates 10 along one ejection port array 14 in the liquid ejection head 3. In FIG. 12B, the positions of the openings 21 are illustrated based on positions from the left side toward the right side in FIG. 12B along the ejection port array direction, i.e., the ejection port positions, and the vertical axis of each graph represents temperature. FIG. 12B also illustrates schematic diagrams of liquid supply channels 18 and liquid collection channels 19 and the openings 21*a* and 21*b* therein, and arrows indicating the flows of the liquid passing therethrough. FIG. 12C is a cross-sectional view illustrating a cross section taken along the line 12C-12C in FIG. 12A, and illustrates the support member 30 and also a first flow path member 50 thereunder. The support member 30 is provided with liquid communication ports 31. The first flow path member 50 is provided with communication ports 51 that connect individual supply flow paths 213 or individual collection flow paths 214 and the liquid communication ports 31. Note that in the following description, of the openings 21 provided in each lid member 20, the openings 21 corresponding to the liquid supply channels 18 will be referred to as the openings 21*a* whereas the openings 21 corresponding to the liquid collection channels 19 will be referred to as the openings 21*b* when the supply-side openings and the collection-side openings are distinguished from each other. Similarly, of the liquid communication ports 31 provided in each support member 30, the liquid communication ports 31 connected to the supply-side openings 21*a* will be referred to as liquid communication ports 31*a* whereas the liquid communication ports 31 connected to the collection-side openings 21*b* will be referred to as liquid communication ports 31*b*. The communication ports formed in the first flow path member 50 at positions corresponding to the liquid communication ports 31*a* and 31*b* will be referred to as communication ports 51*a* and 51*b*, respectively.

Figure 13A:
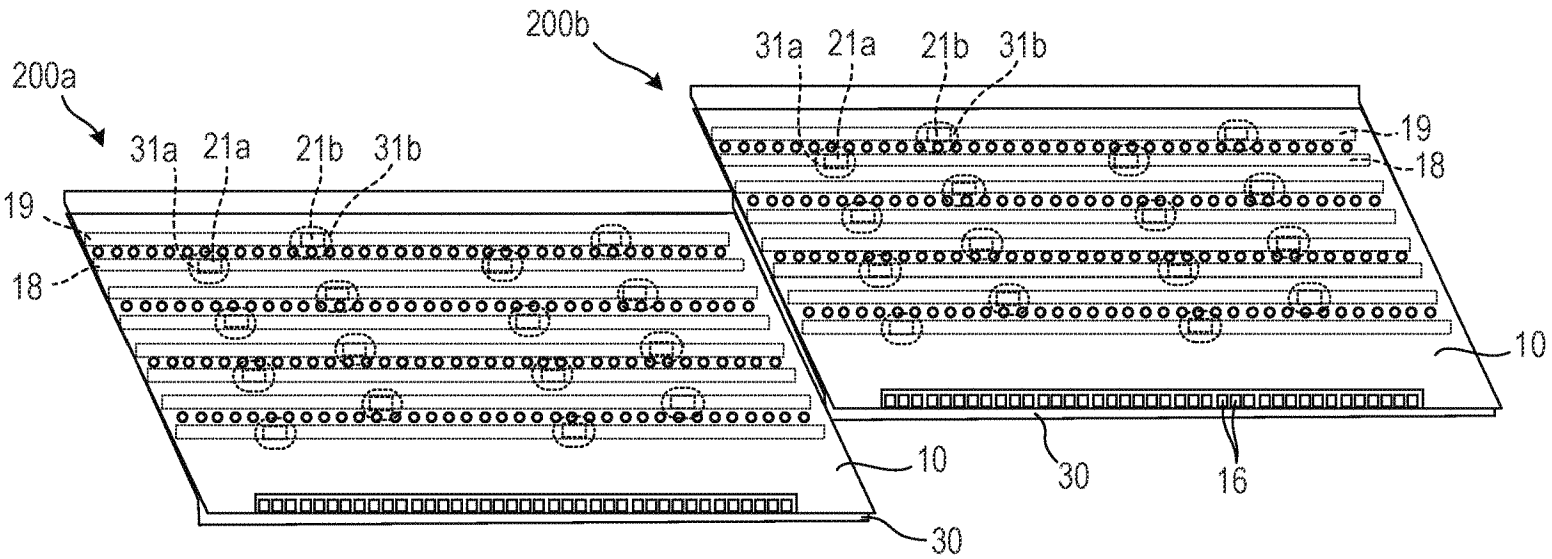
FIG. 13A is a transparent view of the relationship between adjacent ejection modules in a comparative example as seen from their recording element substrate side.
Figure 13B:
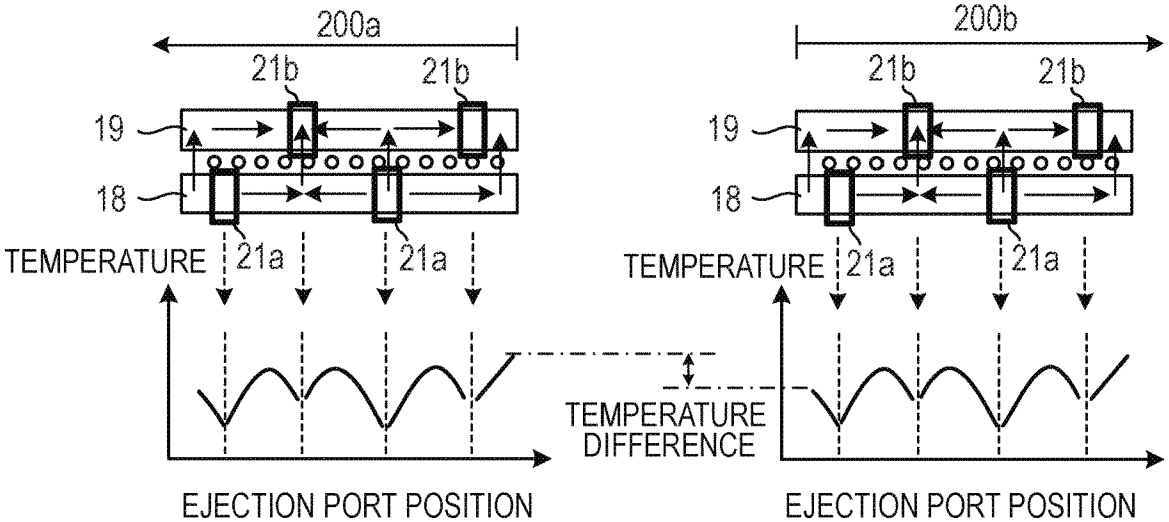
FIG. 13B is a schematic diagram illustrating the relationship between the adjacent ejection modules with respect to the arrangement of openings and the temperature profile in the recording element substrate along one ejection port array in the liquid ejection head.

The liquid ejection head 3 in the present embodiment will be described below while it is compared with a liquid ejection head in a comparative example in which ejection modules 200 of a single type each using the recording element substrate 10 illustrated in FIGS. 8A to 8C are adjacently arranged. FIG. 13A is a transparent view of two adjacent ejection modules 200 in the liquid ejection head in the comparative example as seen from their recording element substrate 10 side, and illustrates the arrangement of the openings 21 in the comparative example. The ejection modules 200 are each formed by arranging a recording element substrate 10 and a flexible wiring substrate 40 on a support member 30. However, the flexible wiring substrate 40 is not illustrated in FIG. 13A for the sake of explanation. FIG. 13B is a diagram corresponding to FIG. 12B in the first embodiment, and illustrates the relationship between the arrangements of the openings 21*a* and 21*b* and the temperature profiles in the recording element substrates 10 along an ejection port array 14 in the comparative example, and also the flows of the liquid.

The configuration in the comparative example is such that the openings 21*a* in each liquid supply channel 18 and the openings 21*b* in the corresponding liquid collection channel 19 are alternately arranged along the ejection port array direction, and liquid ejection modules 200*a* and 200*b* of the same type are adjacently arranged. Accordingly, the collection-side opening 21*b* in the ejection module 200*a* on one side and the supply-side opening 21*a* in the ejection module 200*b* on the other side that are adjacent to each other are the closest pair. In this configuration in the comparative example, when a flow is generated which sequentially passes through the liquid supply channel 18, the pressure chambers 23, and the liquid collection channel 19, the liquid flows heated by the recording elements 15, which are heat generation elements, flows therefrom to the liquid collection channel 19 side, so that the liquid temperature in the liquid collection channel 19 rises. If, under such a condition, the driving duty of the recording elements 15 becomes so high that the amount of the liquid ejected from the ejection ports 13 exceeds the flow rate of the liquid flowing into the pressure chambers 23, the liquid will also be supplied to the pressure chambers 23 from the liquid collection channel 19 side through the openings 21*b*. That is, the liquid will flow in the direction opposite to the direction of the liquid circulation during a non-driving period. As a result, the high-temperature liquid will be supplied from the liquid collection channel 19 side and the temperature of the recording element substrate 10 at the ejection ports 13 around the collection-side openings 21*b* will be higher than the temperature around the supply-side openings 21*a*.

In sum, in the comparative example, when the supply-side openings 21*a* and the collection-side openings 21*b* provided in each liquid ejection module 200 are equal in number, each closest pair of openings in the two adjacent ejection modules 200*a* and 200*b* differ in type (supply side and collection side). In the case illustrated in FIGS. 13A and 13B, the openings in the ejection module 200*a* on the left side of FIGS. 13A and 13B that are located closer to the ejection module 200*b* on the right side of FIGS. 13A and 13B are collection-side openings 21*b*. On the other hand, the openings in the ejection module 200*b* on the right side of FIGS. 13A and 13B that are located closer to the ejection module 200*a* on the left side of FIGS. 13A and 13B are supply-side openings 21*a*. This causes a gap in temperature distribution between the adjacent ejection modules 200*a* and 200*b*, as illustrated in the temperature profiles in FIG. 13B. In the case of a line-type liquid ejection head 3 in which many ejection modules are arranged in series, if such a gap in temperature distribution appears, it will cause a significant temperature difference between adjacent recording element substrates 10. Accordingly, density unevenness that is easily visually noticeable tends to be generated in a recorded image, for example.

In contrast, in the liquid ejection head 3 in the first embodiment, the supply-side openings 21*a* and the collection-side openings 21*b* provided in each lid member 20 are arranged as below. Specifically, as illustrated in FIG. 12A, the ejection module 200*a* illustrated on the left side of FIG. 12A is configured such that the openings 21*a* in each liquid supply channel 18 and the openings 21*b* in the corresponding liquid collection channel 19 are alternately arranged from the left side to the right side along the ejection port array direction. On the other hand, in the ejection module 200*b* illustrated on the right side of FIG. 12A, the openings 21*b* in each liquid collection channel 19 and the openings 21*a* in the corresponding liquid supply channel 18 are alternately arranged from the left side to the right side along the ejection port array direction. Note that as illustrated in FIG. 12C, the openings 31 in the support members 30 and the openings 51 in the first flow path member 50 are provided at positions corresponding to the openings 21, and the openings 51 communicate with the individual flow path grooves 52. Though not illustrated in FIGS. 12A to 12C, the individual flow path grooves 52 communicate with communication ports 72 through openings 61 in a second flow path member 60 and common supply flow paths 211 and common collection flow paths 212 in a third flow path member 70.

According to the first embodiment, each closest pair of openings in the two adjacent ejection modules 200*a* and 200*b* are of the same type, either a pair of supply-side openings 21*a* or collection-side openings 21*b*. Accordingly, as illustrated in FIG. 12B, the temperature difference between the adjacent openings between the two adjacent ejection modules 200*a* and 200*b* is small, so that the temperature difference between the adjacent recording element substrates 10 is reduced as well. In the case of using the liquid ejection head 3 as an inkjet print head, generation of density unevenness in a recorded image is reduced. Thus, the unevenness can be made less visually noticeable.

Second Embodiment

With the liquid ejection head 3 in the first embodiment, two types of ejection modules 200 differing in the arrangement of the openings 21 in the lid member 20 need to be prepared as each two adjacent ejection modules 200, and therefore two types of recording element substrates 10 need to be prepared. This increases the possibility of mismounting the two types of recording element substrates 10 when mounting the recording element substrates 10 onto the respective support members 30 to assemble the two types of ejection modules 200 in the first embodiment. To address this, in the second embodiment, the openings 21 to be provided in the liquid supply channels 18 and the liquid collection channels 19 in the recording element substrate 10 are arranged at common positions for all ejection modules 200. With the ejection modules 200 configured in this manner, it is possible to use recording element substrates 10 of the same type while still preventing a gap in temperature distribution from appearing between each adjacent pair of recording element substrates 10.

Figure 14A:
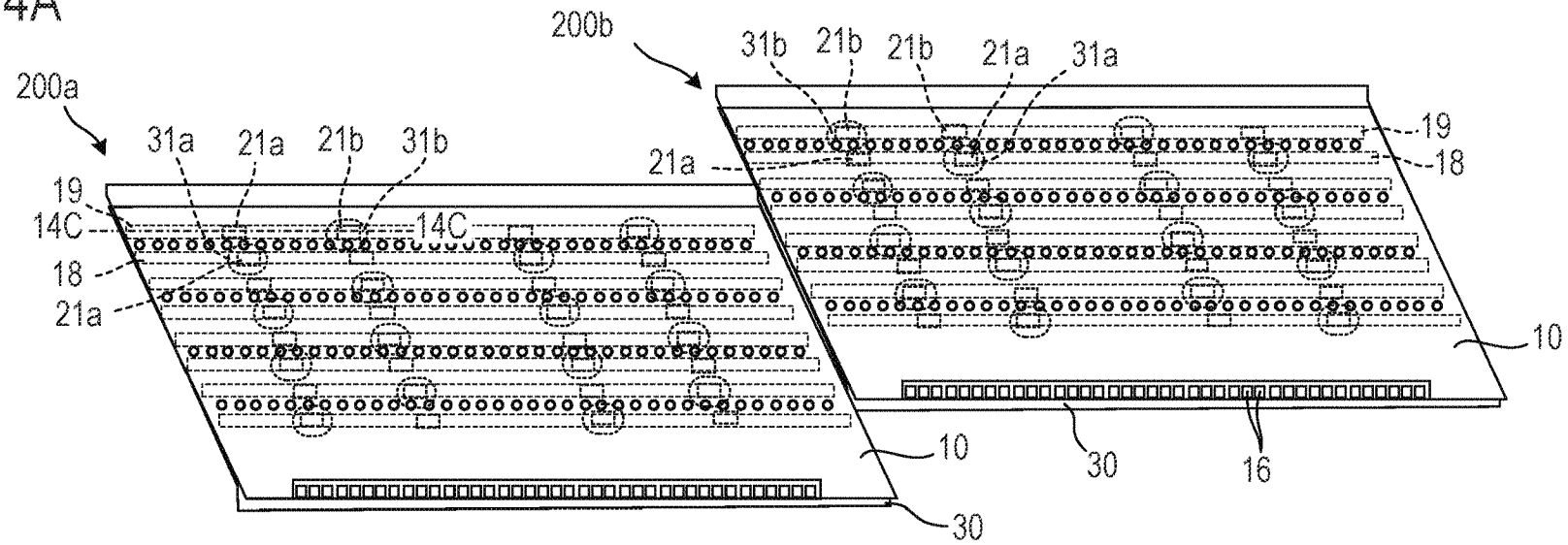
FIG. 14A is a transparent view of the relationship between adjacent ejection modules in a second embodiment as seen from their recording element substrate side.
Figure 14C:
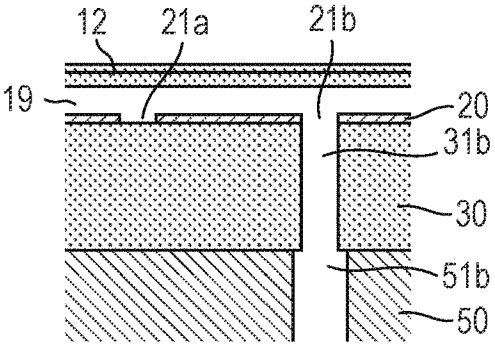
FIG. 14C is a cross-sectional view illustrating a cross section taken along the 14C-14C line in FIG. 14A.
Figure 14B:
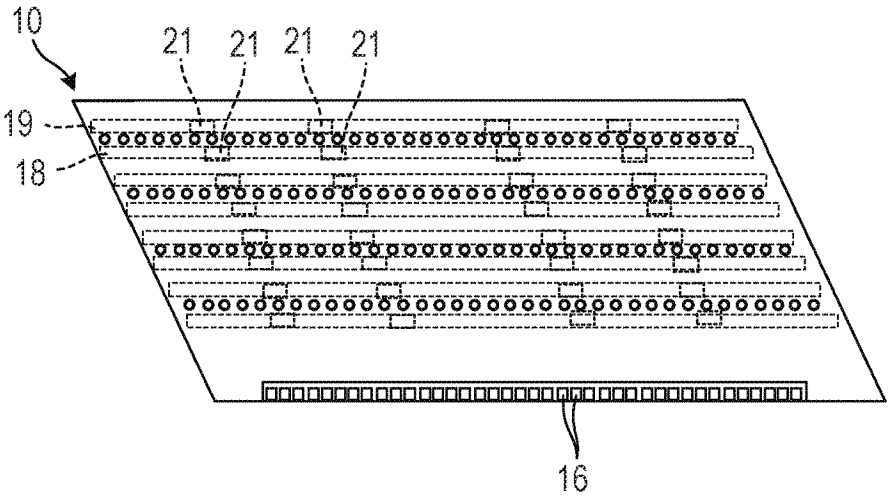
FIG. 14B is a transparent view explaining a recording element substrate.

The liquid ejection head 3 in the second embodiment of the present disclosure will be described below using FIGS. 14A to 14C. FIG. 14A is a transparent view of adjacent liquid ejection modules 200*a* and 200*b* in the recording apparatus 1000 in the present embodiment as seen from their recording element substrate 10 side. FIG. 14B is a transparent view explaining a recording element substrate 10 in the present embodiment. FIG. 14C is a cross-sectional view taken along the line 14C-14C in FIG. 14A, and illustrates a support member 30 and also a first flow path member 50 thereunder. While each ejection module 200 is formed by arranging a recording element substrate 10 and a flexible wiring substrate (not illustrated) on a support member 30, the present embodiment is characterized by the positions of the openings 21 provided in the lid member 20 of each recording element substrate 10. As illustrated in FIG. 14B, in the present embodiment, the openings 21 are provided in the lid member 20 at positions corresponding to both the positions of the openings 21 provided in one of the adjacent ejection modules 200*a* and 200*b* and the positions of the openings 21 provided in the other in the first embodiment. In this way, in the present embodiment, a common recording element substrate 10 can be used in both of the adjacent ejection modules 200*a* and 200*b*. In the present embodiment too, the liquids flow along the ejection port arrays 14 in the two adjacent ejection modules 200*a* and 200*b* in a manner similar to that in the first embodiment described using FIG. 12B so as not to cause a gap in temperature distribution between their recording element substrates 10.

In the present embodiment, the number of openings 21 provided in each ejection module 200 is twice larger than that in the first embodiment. Here, assuming that the liquids flow similarly to the first embodiment, the liquids do not flow through half of the openings 21 provided in the ejection module 200. In the second embodiment, as illustrated in FIGS. 14A and 14C, the openings 21 through which the liquids flow communicate with the liquid communication ports 31 in the support member 30, but the liquid communication ports 31 are not provided in the support member 30 at the positions corresponding to the openings 21 through which the liquids do not flow. In the specific example illustrated in FIG. 14C, the openings 21*a* and 21*b* are provided in the lid member 20 so as to communicate with the liquid collection channel 19. Of these openings, the opening 21*a* is a supply-side opening. Thus, there is no liquid movement into or out of the liquid collection channel 19 through the opening 21*a*, and the opening 21*a* is closed by the support member 30. The opening 21*b*, on the other hand, is a collection-side opening and is to communicate with an individual collection flow path 214. Thus, a liquid communication port 31*b* is formed in the support member 30 at a position corresponding to the opening 21*b*, and the opening 21*b* communicates with the individual collection flow path 214 through the liquid communication port 31*b* and a communication port 51*b* formed in the first flow path member 50.

In the liquid ejection head 3 in the present embodiment, the liquids flow along the ejection port arrays 14 in each recording element substrate 10 similarly to the first embodiment, and therefore the temperature profile in the recording element substrate 10 along the ejection port array direction is also similar to that illustrated in FIG. 12B. Hence, according to the present embodiment, the temperature difference between each adjacent pair of openings between the two adjacent ejection modules 200*a* and 200*b* is small, and therefore the temperature difference between the adjacent recording element substrates 10 is reduced as well. In the case of using the liquid ejection head 3 as an inkjet print head, generation of density unevenness in a recorded image is reduced. Thus, the unevenness can be made less visually noticeable. Moreover, since recording element substrates 10 with the same arrangement, i.e., recording element substrates 10 of the same type, can be used in the adjacent ejection modules 200*a* and 200*b*, the possibility of mismounting can be low when the recording element substrates 10 are mounted onto the support members 30.

Third Embodiment

In the above second embodiment, each two adjacent ejection modules 200*a* and 200*b* use recording element substrates 10 with the same arrangement but still need two types of support members 30, and therefore two types of ejection modules 200 are needed. In the assembly of the liquid ejection head 3, a plurality of ejection modules 200 are arranged onto the long first flow path member 50. Thus, there remains a possibility of mismounting an ejection module(s) 200 when mounting the ejection modules 200 onto the first flow path member 50. In the third embodiment, a description will be given of prevention of a gap in temperature distribution from appearing between adjacent recording element substrates 10 in the case where ejection modules 200 with the same configuration are used as the plurality of ejection modules 200 to be arranged on the first flow path member 50.

Figure 15A:
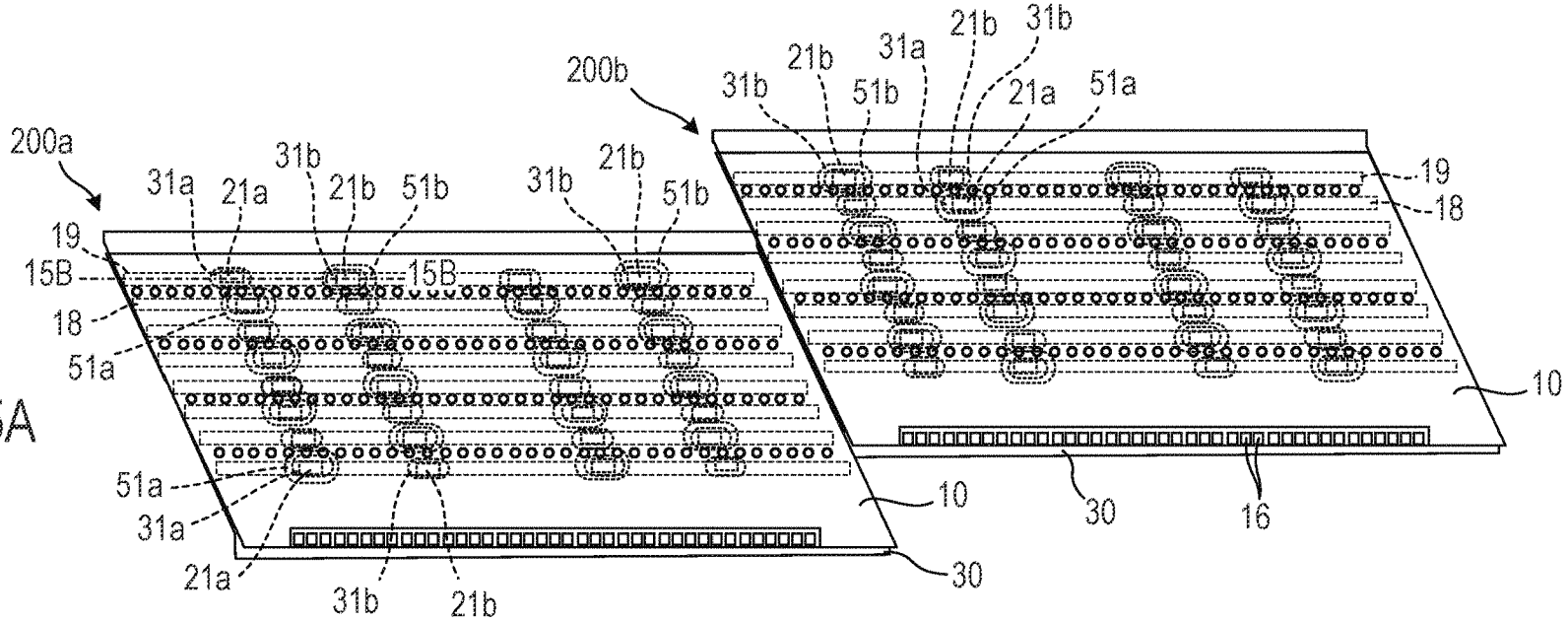
FIG. 15A is a transparent view of the relationship between adjacent ejection modules in a third embodiment as seen from their recording element substrate side.
Figure 15B:
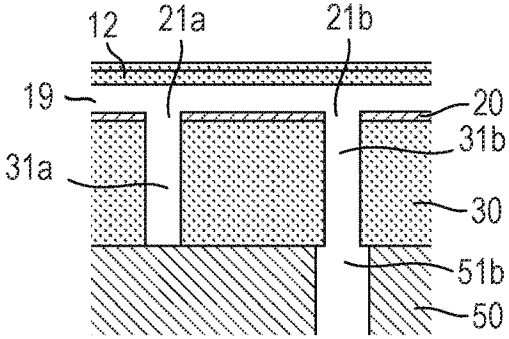
FIG. 15B is a cross-sectional view illustrating a cross section taken along the 15B-15B line in FIG. 15A.

FIG. 15A is a transparent view of adjacent liquid ejection modules 200*a* and 200*b* in the recording apparatus 1000 in the present embodiment as seen from their recording element substrate 10 side. FIG. 15B is a cross-sectional view taken along the line 15B-15B in FIG. 15A, and illustrates a support member 30 and also a first flow path member 50 thereunder. In the present embodiment, while each ejection module 200 is formed by arranging a recording element substrate 10 and a flexible wiring substrate (not illustrated) on a support member 30, recording element substrates 10 with the same arrangement and support members 30 with the same arrangement are used in the plurality of ejection modules 200. Specifically, in the present embodiment, as illustrated in FIG. 15A, the same recording element substrate 10 as that used in the second embodiment is used. In addition, as each support member 30, a member is used in which its liquid communication ports 31 are formed at positions corresponding respectively to all openings 21 formed in the lid member 20 of the recording element substrate 10. In this way, the same support member 30 can be used in the adjacent ejection modules 200*a* and 200*b*. The support member 30 is provided for each ejection module 200. When the liquid ejection unit 300 is formed by arranging the plurality of ejection modules 200 onto a flow path forming member 210, a plurality of the support members 30 are joined to the first flow path member 50 of the flow path forming member 210. In the example illustrated in FIG. 15A, the positions of the openings 21 through which the liquids actually pass are the same as those illustrated in FIG. 12A, and the first flow path member 50 is provided with communication ports 51 at positions corresponding to the openings 21 in each ejection module 200 through which the liquids actually pass. Thus, in the present embodiment, the support members 30 are provided with liquid communication ports 31 that actually communicate with the communication ports 51 and dummy liquid communication ports 31 that do not communicate with the liquid supply channels 18 or the liquid collection channels 19 through the openings 21. The first flow path member 50 is not provided with communication ports 51 corresponding to the dummy liquid communication ports 31, and the dummy liquid communication ports 31 are closed by the first flow path member 50.

FIG. 15A illustrates the positions of the openings 21*a* and 21*b* and the liquid communication ports 31*a* and 31*b* in the ejection modules 200*a* and 200*b*, like FIG. 14A, and further illustrates the positions of some communication ports 51*a* and 51*b* provided in in the first flow path member 50. In this embodiment, each support member 30 is provided with the liquid communication ports 31*a* and 31*b* at positions corresponding to all openings 21*a* and 21*b* in the lid member 20. In FIG. 15A, the openings 21*a* and 21*b* through which the liquids actually flow are illustrated as if they are present inside the communication ports 51*a* and 51*b*. However, the openings 21*a* and 21*b* and therefore the liquid communication ports 31*a* and 31*b* through which the liquids to not actually flow are not surrounded by the communication ports 51*a* and 51*b*. In the third embodiment, only the liquid communication ports 31 and the openings 21 communicating with the communication ports 51 in the first flow path member 50 are connected to individual supply flow paths 213 and individual collection flow paths 214, and the liquids flow through these. This enables the liquids to be supplied to and collected from the liquid ejection head 3. The liquid communication ports 31 and the openings 21 not communicating with the communication ports 51 are not connected to the individual supply flow paths 213 or the individual collection flow paths 214, and therefore the liquids do not flow through them.

In the liquid ejection head 3 in the third embodiment, the liquids flow along the ejection port arrays 14 in each recording element substrate 10 similarly to the first embodiment, and therefore the temperature profile in the recording element substrate 10 along the ejection port array direction is also similar to that illustrated in FIG. 12B. Hence, according to the present embodiment, the temperature difference between each adjacent pair of openings between the two adjacent ejection modules 200*a* and 200*b* is small, and therefore the temperature difference between the adjacent recording element substrates 10 is reduced as well. In the case of using the liquid ejection head 3 as an inkjet print head, generation of density unevenness in a recorded image is reduced. Thus, the unevenness can be made less visually noticeable. Further, in the present embodiment, the adjacent ejection modules 200*a* and 200*b* can use not only the recording element substrate 10 with the same arrangement but also the support members 30 with the same arrangement. This makes it possible to prevent mismounting in the assembly of the liquid ejection modules 200*a* and 200*b*.

According to the embodiments described above, it is possible to obtain a liquid ejection head in which a gap in temperature distribution is prevented from appearing between adjacent recording element substrates.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-110698, filed Jun. 26, 2020, which is hereby incorporated by reference herein in its entirety.

What is claimed is:

1. A liquid ejection head in which at least two ejection modules are arrayed adjacently on a flow path forming member, each of the ejection modules including a support member, a lid member and a recording element substrate which are laid sequentially on one another, wherein the recording element substrate includes an ejection port array including a plurality of ejection ports arrayed in a direction in which a first ejection module and a second ejection module are arrayed adjacently and a liquid supply channel and a liquid collection channel each extending in the direction on one and the other sides of the ejection port array respectively as sandwiching the ejection port array, the liquid ejection head includes two or more supply-side liquid communication paths each comprising a communication port provided in a flow path member constituting the flow path forming member, a liquid communication port provided in the support member and an opening provided in the lid member through which to supply a liquid to the liquid supply channel, and the same number of collection-side liquid communication paths each comprising a communication port provided in the flow path member, a liquid communication port provided in the support member and an opening provided in the lid member through which to collect the liquid from the liquid collection channel, the supply-side liquid communication paths and the collection-side liquid communication paths are alternately arranged along the direction such that the ejection port array is sandwiched between one of the supply-side liquid communication paths and one of the collection-side liquid communication paths, and the liquid ejection head is configured such that two of the supply-side liquid communication paths or two of the collection-side liquid communication paths are arranged close to adjacent ends of the first and second ejection modules.

2. The liquid ejection head according to claim 1, wherein the plurality of ejection ports included in the recording element substrate communicate individually with a plurality of corresponding pressure chambers, each of the pressure chambers includes:

a recording element which is driven to eject the liquid from the corresponding ejection port communicating with the pressure chamber;

a supply port through which the liquid is supplied to the pressure chamber; and a collection port through which the liquid supplied from the supply port is discharged from the pressure chamber after passing through the pressure chamber.

3. The liquid ejection head according to claim 1, wherein the flow path forming member includes:

a common supply flow path and a common collection flow path provided in common to at least the first and second ejection modules);

supply-side communication ports connecting the common supply flow path and individual supply flow paths; and collection-side communication ports connecting the common collection flow path and individual collection flow paths.

4. The liquid ejection head according to claim 1, wherein the supply-side liquid communication paths and the collection-side liquid communication paths are arranged in line-symmetric relative to the adjacent ends of the first and second ejection modules.

5. A liquid ejection apparatus comprising:

the liquid ejection head according to claim 1;

a storage part that stores the liquid; and a liquid transfer part that performs supply and collection of the liquid between the storage part and the liquid ejection head.

6. The liquid ejection head according to claim 1, wherein the liquid ejection head is formed by arraying a plurality of pairs each including the first ejection module and the second ejection module.

7. The liquid ejection head according to claim 1, wherein the lid member constituting the first ejection module has an opening also at each position corresponding to the liquid communication ports in the support member and the communication ports in the flow path member constituting the supply-side liquid communication path provided in the second ejection module, and a set of the lid member and the recording element substrate constituting the first ejection module is used also as a lid member and a recording element substrate for the second ejection module.

8. The liquid ejection head according to claim 1, wherein the lid member and the support member constituting the first ejection module has an opening and a liquid communication port also at each position corresponding to the liquid communication ports in the flow path member constituting the supply-side liquid communication path provided in the second ejection module, and the first ejection module is used also as the second ejection module.

* * * * *